US007113452B2

(12) United States Patent
Fujita et al.

(10) Patent No.: US 7,113,452 B2
(45) Date of Patent: Sep. 26, 2006

(54) ELECTRONIC TIMEPIECE

(75) Inventors: Kenji Fujita, Sayama (JP); Akiyoshi Murakami, Ageo (JP); Haruhiko Higuchi, Tokorozawa (JP); Motoki Funahashi, Tokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 383 days.

(21) Appl. No.: 10/111,844

(22) PCT Filed: Sep. 13, 2001

(86) PCT No.: PCT/JP01/07961

§ 371 (c)(1),
(2), (4) Date: Apr. 30, 2002

(87) PCT Pub. No.: WO02/23285

PCT Pub. Date: Mar. 21, 2002

(65) Prior Publication Data

US 2002/0154575 A1 Oct. 24, 2002

(30) Foreign Application Priority Data

Sep. 13, 2000 (JP) ..... 2000-277383

(51) Int. Cl.
*G04B 9/00* (2006.01)
*G04C 1/00* (2006.01)

(52) U.S. Cl. ..... 368/66; 368/204

(58) Field of Classification Search ..... 368/80, 368/155–157, 64, 66, 203, 204, 223
See application file for complete search history.

(56) References Cited

U.S. PATENT DOCUMENTS 4,759,003 A 7/1988 Kiyono et al.
5,446,702 A * 8/1995 Mossuz et al. ..... 368/37
5,699,322 A * 12/1997 Born ..... 368/66
5,889,736 A * 3/1999 Fujita et al. ..... 368/66
6,061,304 A * 5/2000 Nagata et al. ..... 368/66
6,147,936 A * 11/2000 Nakajima ..... 368/205

FOREIGN PATENT DOCUMENTS

| | | |
|---|---|---|
| JP | 57-14080 | 1/1982 |
| JP | 59-137590 | 9/1984 |
| JP | 62-201388 | 9/1987 |
| JP | 9-264973 | 10/1997 |
| JP | 11-133165 | 5/1999 |
| JP | 2000-121758 | 4/2000 |

* cited by examiner

*Primary Examiner*—Vit W. Miska
(74) *Attorney, Agent, or Firm*—Foley & Lardner LLP

(57) ABSTRACT

When a stem switch (8) is pulled out, a switch signal forming unit 9 outputs a signal (RS) indicating that effect, a control unit (13) receives the signal (RS) and starts clocking by a timer (13*a*). The control unit (13) receives a signal (HS) output from an electricity-generation detecting unit (12) within the clocking period, detects the electricity generating operation of an electricity generating unit (10), and outputs a signal (CS) indicating that effect. A narrow pulse forming unit (7) forms a narrow pulse having a width of such a degree that the motor (5) is not driven based on the signal (CS), and outputs the narrow pulse to a motor driving circuit (4). The motor driving circuit (4) flows a fine current through a coil (4*a*) which drives the motor (5) based on the narrow pulse. An external device detects a variation of the narrow pulse, thereby confirming whether electricity is generated.

41 Claims, 21 Drawing Sheets

ELECTRONIC TIMEPIECE

TECHNICAL FIELD

The present invention relates to an electronic watch capable of confirming an inside normal operation in a product form. More particularly, this invention relates to an electronic watch capable of confirming an operation state of an embedded electricity generating unit.

BACKGROUND ART

In electronic devices of recent years, there is a tendency of lighter weighted, thinner thickness, shorter length and smaller size, but there is a problem on securing a high output and a small power source. To solve the problem, attempt has been made to lower the power consumption and to elongate the lifetime of a secondary battery of each of various devices that constitute the electronic device.

The best example of the electronic device of lighter weighted, thinner thickness, shorter length and smaller size is a portable electronic watch. The portable electronic watch has smaller power consumption and smaller size as compared with a mobile phone which has remarkably been developed in recent years. Therefore, even when a primary battery such as a button type lithium battery is used as an embedded power source, changing frequency is once in several years, which is sufficiently practical. However, for users, it is troublesome to change battery even once in several years, and it requires costs. Even when a secondary battery is used as the embedded battery, it is troublesome to charge the battery. Especially with the electronic watch, it is necessary to reset the time after the battery is changed, and therefore it is not preferable to repeatedly inflict such operation on users.

Thereupon, an electronic watch in which an electricity generating device that generates electricity to be stored in the secondary battery is embedded together with the secondary battery, has been commercialized. A solar cell which converts optical energy to electricity, a thermionic element which converts energy due to a temperature difference between body heat and outside air temperature into electricity, a rotating weight which converts kinetic energy into electricity, or the like is used as the electricity generating device.

Not only a digital display type electronic watch using a liquid crystal but also an analogue display type electronic watch using hands in many cases includes an IC chip which generates a reference clock or controls a motor which rotates the hands. The electricity generated by the electricity generating device is consumed as driving voltage of the IC chip or the motor through the secondary battery.

Therefore, in the electronic watch having the electricity generating device, it is important that the electricity generating device is excellent in order to keep the stable watch operation, and the operation is carefully confirmed during producing procedure also.

Especially, the electronic watch is small in size, and therefore the operation of the electricity generating device alone is usually checked first in pre-step in which constituent parts of the electronic watch are incorporated. Subsequently, the electricity generating device which was confirmed as a fair quality is incorporated into the electronic watch and the operation of the electronic watch is confirmed.

However, electricity to some extent is stored in the secondary battery which is incorporated together with the electricity generating device. Therefore, an electronic watch which is operated using the electricity stored in the secondary battery sometimes shows normal watch operation immediately after the incorporation, even when the electricity generating device is damaged during incorporation. The damage of the electricity generating device mentioned here includes damage of the electricity generating device itself caused by generation of static electricity during the incorporation, and also includes such when electric wiring between the electricity generating device and the secondary battery is disconnected and the electricity generating operation of the electricity generating device can not be confirmed visually.

In an electronic watch which was shipped as being a normal watch for the above reason, the stored electricity of the secondary battery runs out after a while, and the watch operation is stopped.

Thus, after the electronic watch was assembled, i.e., in a product form immediately before shipment, an electricity generating device capable of confirming the operation has been required.

It is an object of the present invention to provide an electronic watch capable of easily confirming the operation of a built-in electricity generating device in a product form.

DISCLOSURE OF THE INVENTION

The electric watch according to the present invention is provided with an electricity generating unit and is driven by electricity generated by the electricity generating unit. The electric watch comprises an external operating member, an operation detecting unit which outputs an operation signal when the external operating member is operated, an electricity-generation detecting unit which outputs an electricity-generation detecting signal when it is detected that the electricity generating unit is generating electricity, and a notifying unit which notifies an electricity generating state of the electricity generating unit to outside based on the operation signal and the electricity-generation detecting signal.

The electronic watch according to a next invention comprises at least an hour hand and a minute hand, a motor which rotates the hands, and a waveform shaping unit that forms a driving pulse for carrying out a clocking operation. The notifying unit changes a driving mode of the motor based on the operation signal, the electricity-generation detecting signal, and the driving pulse.

The electronic watch according to a next invention is provided with an electricity generating unit and is driven by electricity generated by the electricity generating unit. The electric watch comprises an electricity-generation detecting unit which outputs an electricity-generation detecting signal when it is detected that the electricity generating unit is generating electricity, at least an hour hand and a minute hand, a motor which rotates the hands, a waveform shaping unit which forms a driving pulse for carrying out a clocking operation, a pulse forming unit which forms a narrow pulse based on the electricity-generation detecting signal, and a motor driving unit which drives the motor based on the driving pulse and outputs a signal that notifies an electricity generating state of the electricity generating unit to outside based on the narrow pulse.

The electronic watch according to a next invention comprises an external operating member, and an operation detecting unit which outputs an operation signal when the external operating member is operated. The pulse forming unit generates a narrow pulse based on the operation signal and the electricity-generation detecting signal.

In the electronic watch according to a next invention, the pulse forming unit generates the narrow pulse based on the operation signal and the electricity-generation detecting signal during a predetermined clocking period which is started based on the operation signal.

In the electronic watch according to a next invention, the electricity-generation detecting unit detects whether the electricity generating unit is generating electricity during a predetermined clocking period which is started based on the operation signal, and outputs an electricity-generation detecting signal when it is detected that electricity is generated.

In the electronic watch according to a next invention, the motor driving unit notifies the electricity generating state of the electricity generating unit to outside by conducting a pulse signal having a width of such a degree that the motor is not driven, to a coil for driving the motor based on the narrow pulse.

In the electronic watch according to a next invention, the electricity-generation detecting unit repeatedly outputs the electricity-generation detecting signal for a predetermined time when it is detected that the electricity generating unit is generating electricity.

In the electronic watch according to a next invention, the electricity-generation detecting unit outputs the electricity-generation detecting signal based on a time period or a number of repeating times which is in proportion to an electricity generating amount of the electricity generating unit.

The electronic watch according to a next invention, comprises a storage unit which stores electricity generated by the electricity generating unit, and a voltage detecting unit which outputs a voltage detection signal indicating a voltage state of the storage unit. The pulse forming unit generates a narrow pulse based on at least the voltage detection signal and the electricity-generation detecting signal.

In the electronic watch according to a next invention, the pulse forming unit generates the narrow pulse based on the operation signal and the electricity-generation detecting signal during a predetermined clocking period which is started based on the electricity-generation detecting signal.

The electronic watch according to a next invention comprises a rate pulse generating unit which generates rate pulses. The pulse forming unit forms narrow pulses which are output at equal intervals at timing which is substantially middle between the output intervals of the rate pulses, and the motor driving unit notifies the output state of the rate pulses and the electricity generating state of the electricity generating unit to outside by conducting a pulse signal having a width of such a degree that the motor is not driven, to a coil for driving the motor based on the rate pulses and narrow pulses.

In the electronic watch according to a next invention, the external operating member is a stem switch.

In the electronic watch according to a next invention, the external operating member is a push switch.

In the electronic watch according to a next invention, the external operating member is a push switch, and the pulse forming unit generates the narrow pulse based on the operation signal and the electricity-generation detecting signal during a predetermined clocking period which is started in immediate response to release of the push switch that is kept pushed for more than a predetermined time.

The electronic watch according to a next invention, comprises a first external operating member, a second external operating member, a first operation detecting unit which outputs a first operation signal when the first external operating member is operated, and a second operation detecting unit which outputs a second operation signal when the second external operating member is operated. The pulse forming unit generates the narrow pulse based on the first operation signal, the second operation signal, and the electricity-generation detecting signal.

In the electronic watch according to a next invention, the pulse forming unit generates the narrow pulse based on the electricity-generation detecting signal during a predetermined first clocking period which is started based on the first operation signal or during a second clocking period which is determined based on the first operation signal and the second operation signal.

In the electronic watch according to a next invention, the narrow pulse is not generated during a predetermined time immediately after the push switch pushed down for more than a predetermined time is released within the clocking period.

The electronic watch according to a next invention, comprises a storage unit which stores electricity generated by the electricity generating unit, a voltage detecting unit which outputs a voltage detection signal indicating a voltage state of the storage unit, and an overcharge preventing unit which prevents overcharge of the storage unit by being controlled based on the voltage detection signal. The overcharge preventing unit is brought into a non-operative state at timing at which the electricity-generation detecting unit operates.

The electronic watch according to a next invention, comprises at least an hour hand and a minute hand, a motor which rotates the hands, an external operating member, an operation detecting unit which outputs an operation signal when the external operating member is operated, a waveform shaping unit which forms a driving pulse which carries out the clocking operation, a pulse forming unit which forms a narrow pulse based on the operation signal, and a motor driving unit which drives the motor based on the driving pulse, and which conducts a pulse signal having a width of such a degree that the motor is not driven, to a coil for driving the motor based on the narrow pulse.

BEST MODE FOR CARRYING OUT THE INVENTION

Embodiments of the electronic watch according to the present invention will be explained in detail with reference to the accompanying drawings. The invention is not limited by the embodiments.

Figure 1:
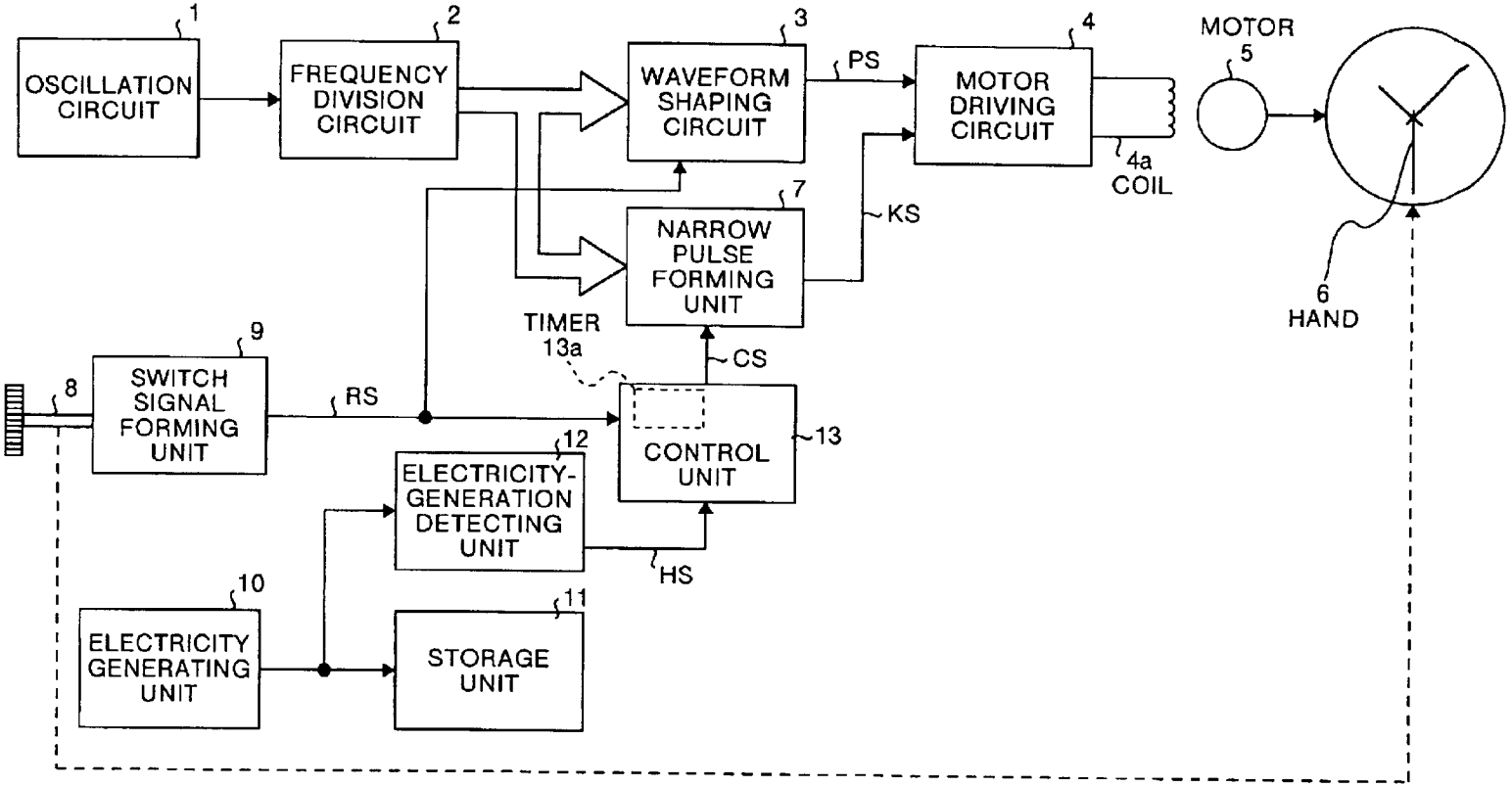
FIG. 1 is a block diagram which schematically shows a configuration of an electronic watch according to a first embodiment.

First, an electronic watch of a first embodiment will be explained. FIG. 1 is a block diagram which schematically shows the configuration of the electronic watch according to the first embodiment. In FIG. 1, the electronic watch of the first embodiment comprises an oscillation circuit 1 which generates a reference signal, a frequency division circuit 2 which forms clock signals of a plurality of different frequencies based on the reference signal, a waveform shaping circuit 3 which forms a signal Ps which drives a later-described motor based on a plurality of signals output by the frequency division circuit 2, a motor driving circuit 4 which has a coil 4*a* and which converts the signal PS output from the waveform shaping circuit 3 into a pulse signal which becomes a motor driving signal, a motor 5 which is rotated by current flowing through the coil 4*a*, a hand 6 which shows time by driving the motor 5, a stem switch 8 which mechanically corrects the hand 6, an electricity generating unit 10 comprising a solar cell or the like, and a storage unit 11 which stores electricity generated by the electricity generating unit 10 and which serves as a power source of the constituent elements. These constituent elements carry out the basic watch operation.

In addition to the above structure, this electronic watch further comprises a switch signal forming unit 9 which outputs, when the stem switch 8 is pulled, a signal RS indicating such effect, an electricity-generation detecting unit 12 which detects whether the electricity generating unit 10 is generating electricity based on sampling for its detection ("detection sampling") performed at a predetermined timing, and which outputs a signal HS indicating that electricity is being generated when it is so identified, a control unit 13 which outputs a signal CS based on the signal RS output from the switch signal forming unit 9 and the signal HS output from the electricity-generation detecting unit 12, and a narrow pulse forming unit 7 which outputs a signal KS having small pulse width at two-second intervals for example, based on the signal CS output from the control unit 13.

The control unit 13 has a built-in timer 13*a*, and the signal CS is kept outputting for a time regulated by the timer 13*a*, for example, only for one minute.

Figure 2:
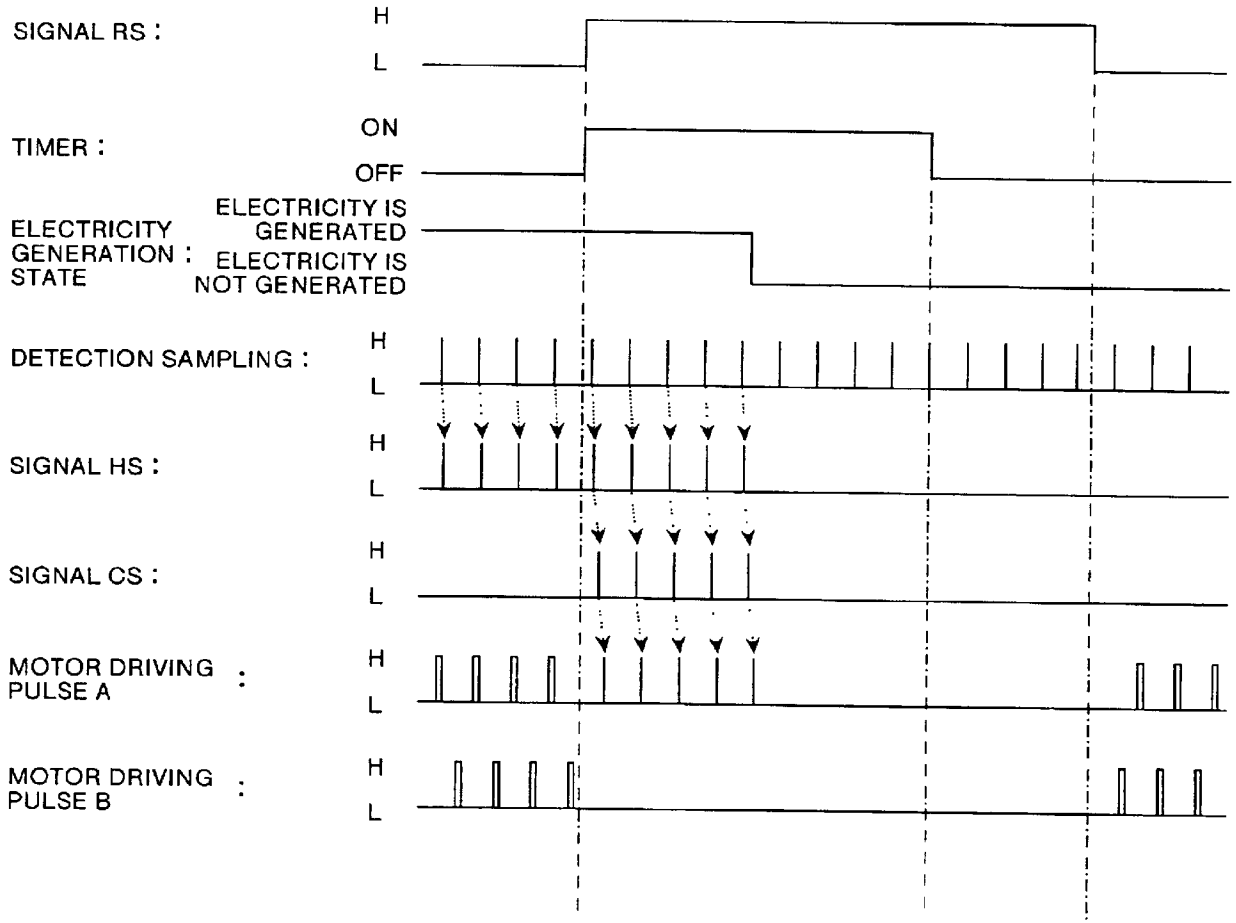
FIG. 2 is a time chart which explains the operation of the electronic watch of the first embodiment.

The operation of the electronic watch according to the first embodiment will be explained. FIG. 2 is a time chart which explains the operation of the electronic watch of the first embodiment.

In FIG. 2, the electricity-generation detecting unit 12 always checks generation/non-generation of electricity in the electricity generating unit 10 at predetermined timing such as two-second intervals, and outputs a short pulse (line pulse in the figure) which follows the predetermined timing as a signal HS when the electricity is being generated.

When the stem switch 8 is in its normal state, the signal RS output from the switch signal forming unit 9 shows logic level "L", and in this state, the waveform shaping circuit 3 alternately outputs two pulses with a predetermined pulse width so that a time interval between the two pulses becomes one second. Here, a pulse which energizes the coil 4*a* in one direction is defined as a motor driving pulse A (rectangular pulse in the figure), and a pulse which energizes the coil 4*a* in the other direction is defined as a motor driving pulse B (rectangular pulse in the figure). The signal PS shown in FIG. 1 corresponds to the motor driving pulse A and motor driving pulse B.

The motor driving circuit 4 alternately switches the nnergization direction of the coil 4*a* based on the motor driving pulse A and motor driving pulse B (both the pulses are called as hand-moving pulses, hereinafter) and rotates the motor 5. The rotation of the motor 5 allows the hand 6 to rotate at one-second intervals, i.e., to move the hand 6 by six degrees each time.

On the other hand, when the stem switch 8 is pulled out, the hand can be freely rotated through a back rotation mechanism not shown by rotating the stem switch 8, and it is thereby possible to correct the time. In this case, the switch signal forming unit 9 further outputs a logic level "H" as the signal RS, the waveform shaping circuit 3 receives the signal RS at logic level "H", and stops the outputs of the motor driving pulse A and motor driving pulse B. That is, stopping the outputs causes the movement of the hand 6 to stop.

The signal RS at logic level "H" output from the switch signal forming unit 9 is also input to the control unit 13, and the control unit 13 starts the clocking by the timer 13*a* in synchronism with rising edge of the signal RS at logic level "H".

If receiving a signal HS of short pulse indicating that electricity is being generated during a period when the signal RS shows logic level "H" and the timer 13*a* is clocking, i.e., during the period when the timer 13*a* is ON (this state is called electricity generation confirming mode, hereinafter), the control unit 13 outputs a short pulse (line pulse in the figure), as a signal CS, following the signal HS.

The narrow pulse forming unit 7 receives the signal CS of short pulse, generates a pulse of width smaller than those of the motor driving pulse A and motor driving pulse B, especially a pulse of width smaller than a pulse width which is required to drive the motor 5 in the motor driving circuit 4, and outputs the generated pulse as a signal KS.

When receiving the signal KS of narrow pulse, the motor driving circuit 4 flows fine current corresponding to the narrow pulse through the coil 4*a*, but the motor 5 is not rotated and the hand 6 is not moved. FIG. 2 shows that the signal KS of narrow pulse is input as the motor driving pulse A, but the signal KS may be input as the motor driving pulse B.

Since the fine current flowing through the coil 4*a* causes fine magnetic field of the coil 4*a* to vary, the signal KS of narrow pulse can be detected indirectly through detection of the variation in the fine magnetic field by an external device. That is, it is possible to recognize, from outside the electronic watch, whether the electricity generating unit 10 is generating electricity, which means that it is possible to check the operation of the electricity generating unit 10 for a product in a completed form.

As explained above, the motor 5 is not rotated by the fine current which is conducted based on the signal KS because the hand 6 is mechanically stopped when the stem switch 8 is pulled out in the first place. It is desirable that the pulse width of the signal KS is as small as possible from the viewpoint of later-described power consumption.

After the stem switch 8 is pulled, the timer 13*a* operates, but when its clocking time, one minute in the above example is elapsed, time-counting is completed, and the control unit 13 stops the output of the signal CS irrespective of state of the signal HS. A reason why the timer 13*a* is provided is that the fine current which is conducted based on the signal KS of narrow pulse requires not some little power consumption. Thus, when the stem switch 8 is left pulled for a long term by a user in its normal use and insufficiently generated electricity amount is obtained although electricity generating operation is carried out (for example, when a solar cell as the electricity generating unit 10 is left in a dark place), the electricity stored in the storage unit 11 is prevented from being wastefully consumed based on generation of the signal KS.

As explained above, according to the electronic watch of the first embodiment, the electricity-generation detecting unit 12 is provided and the narrow pulse is output to the motor driving circuit 4 based on the electricity-generation detecting signal (signal HS). Therefore, it is possible to check whether the electricity generating unit 10 operates normally even when the electronic watch is a product in a completed form.

Further, since a narrow pulse is output only for a predetermined period based on the operation of the stem switch 8, it is possible to check the operation without wasteful power consumption.

Further, since the stem switch 8 which is necessary to correct time is used as a unit which shifts the mode to the electricity generation confirming mode to check presence or absence of the generated electricity, it is possible to suppress the costs without adding new elements.

In the first embodiment, the narrow pulse is output when the electricity generating unit 10 shows the electricity generating state. Conversely, when the electricity generating unit 10 is in non-electricity generating state, the narrow pulse may be configured to output. The present invention can be also applied to this case. In this case, when a narrow pulse is not detected even when the stem switch 8 is pulled during electricity generation, it is possible to confirm that the electricity generating unit 10 is operating.

Next, an electronic watch of the second embodiment will be explained. The electronic watch of the second embodiment is such that a plurality of pulses are output as signal HS when the electricity-generation detecting unit 12 shown in FIG. 1 detects that electricity is being generated in one-time detection sampling. Since a schematic configuration of the electronic watch of the second embodiment is the same as that shown in FIG. 1, its explanation will be omitted.

Figure 3:
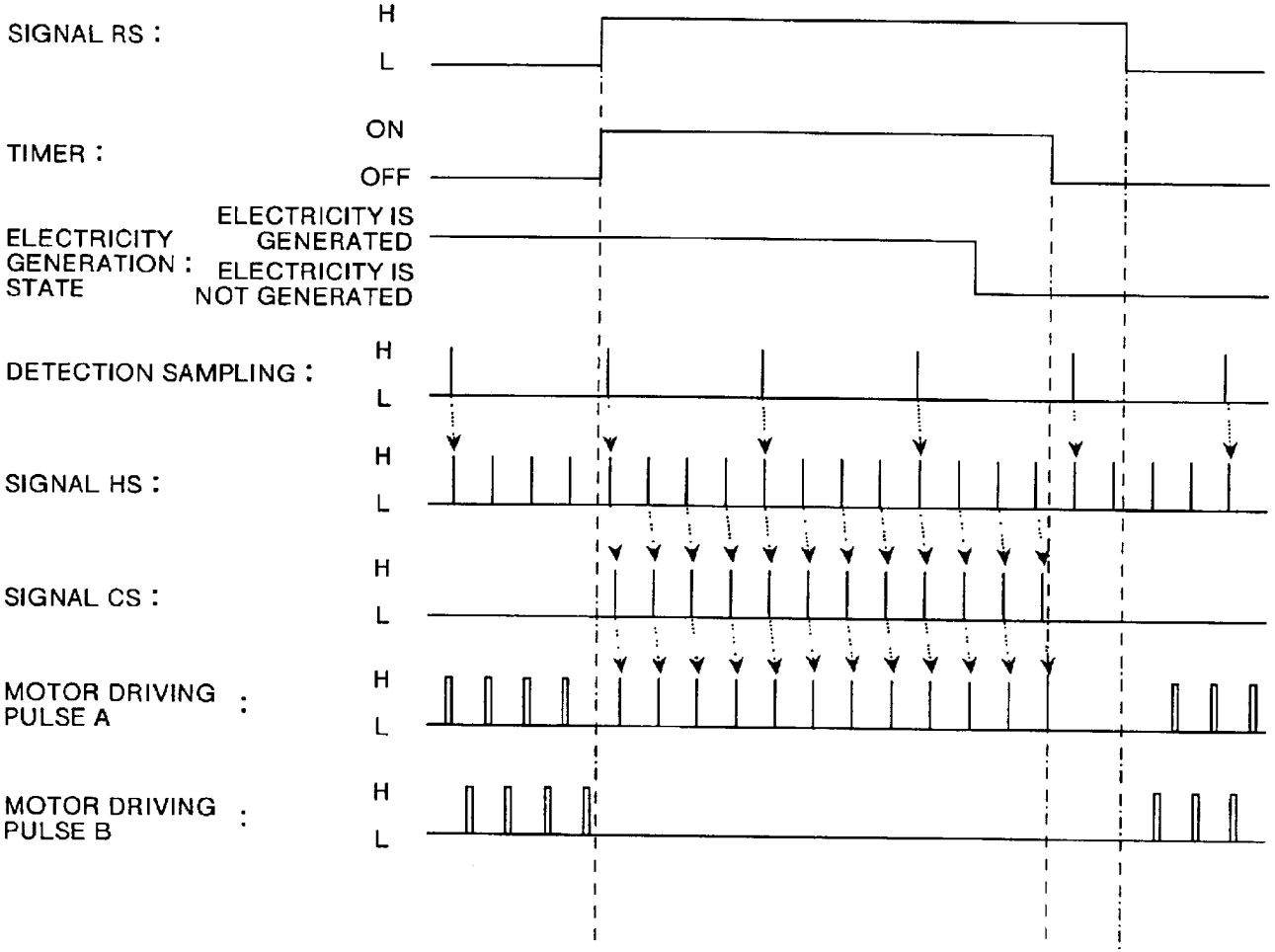
FIG. 3 is a time chart which explains the operation of an electronic watch of a second embodiment.

The operation of the electronic watch of the second embodiment will be explained. FIG. 3 is a time chart which explains the operation of the electronic watch of the second embodiment.

Since the operation of any units other than the electricity-generation detecting unit 12 is the same as that shown in FIG. 2, only the time chart concerning the operation of the electricity-generation detecting unit 12 will be explained. As an example here, the electricity-generation detecting unit 12 is assumed to carry out detection sampling at four-second intervals.

As shown in FIG. 3, the electricity-generation detecting unit 12 outputs short pulses (line pulses in the figure) at one-second intervals continuously four times with respect to one-time sampling for detection of short pulse, as the signals HS.

As explained in the first embodiment, among pulses output as the signals HS, only pulses belonging to a period in which the timer 13*a* is in its ON state are targets to be followed by the control unit 13, and the respective pulses are output as the signals CS.

Each of the signals CS is input to the narrow pulse forming unit 7 and is output as signal KS of narrow pulse, and the signal KS is detected by an external device through the coil 4*a* like in the first embodiment.

After all, in this example, once detected that the electricity is generating, the external device can detect four pulses having one-second interval with respect to the one-time detection. In other wards, after the stem switch 8 is pulled out, it is possible to confirm presence or absence of electricity generation for the following four seconds with respect to one-time detection sampling.

This is especially effective when a thermionic element or a rotating weight is used as the electricity generating unit 10. The reason thereof is as follows. First, the thermionic element requires thermal energy to carry out the electricity generating operation, and the rotating weight requires kinetic energy to carry out the electricity generating operation. Therefore, the electronic watch explained in the first embodiment requires such an auxiliary electricity generating mechanism as an external device used to confirm the electricity generating state. In contrast to this, the electronic watch of the second embodiment is put around the arm, and thermal energy or kinetic energy is appropriately applied to the electronic watch before being mounted to the external device and allows the electricity generating unit 10 to start. Even when the electronic watch is mounted to the external device immediately thereafter, it is possible to sufficiently confirm the electricity generating state by the external device.

As explained above, according to the electronic watch of the second embodiment, the effect explained in the first embodiment is obtained, and at the same time a plurality of narrow pulses (signal KS) are output to the motor driving circuit 4 in one detecting operation of the electricity generation. Therefore, it is possible to detect generation of the narrow pulse by the external device immediately after the electronic watch is put on a person's body to give some energy for electricity generation thereto like in an actual use, even when the condition on giving the energy for electricity generation to the watch like in an element such as the thermionic element or the rotating weight is more complicated as compared with the solar cell. Thus, it is possible to confirm the electricity generating state.

Next, an electronic watch of a third embodiment will be explained. The electronic watch of the third embodiment includes an electricity generating amount detecting unit 31 which outputs a number of necessary pulses in accordance with the electricity generating amount by the electricity generating unit 10, instead of the electricity-generation detecting unit 12 shown in FIG. 1.

Figure 4:
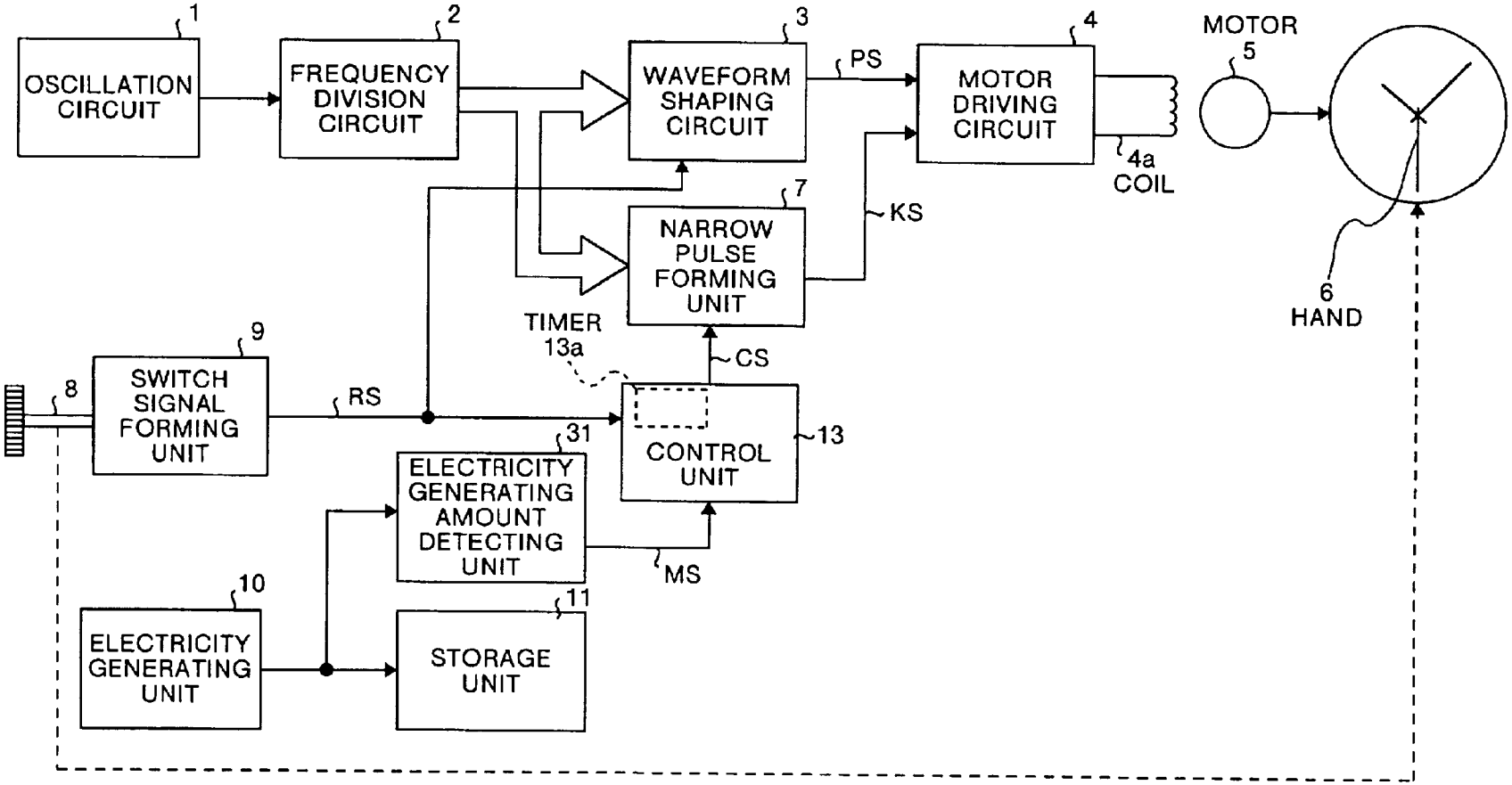
FIG. 4 is a block diagram which schematically shows a configuration of an electronic watch of a third embodiment.

FIG. 4 is a block diagram which schematically shows a configuration of the electronic watch of the third embodiment. In FIG. 4, parts common to those shown in FIG. 1 are designated with the same symbols, and explanation thereof will be omitted. The electronic watch shown in FIG. 4 is different from that of FIG. 1 in that the electricity-generation detecting unit 12 is replaced by an electricity generating amount detecting unit 31, and a signal MS is output from the electricity generating amount detecting unit 31 to the control unit 13.

Figure 5:
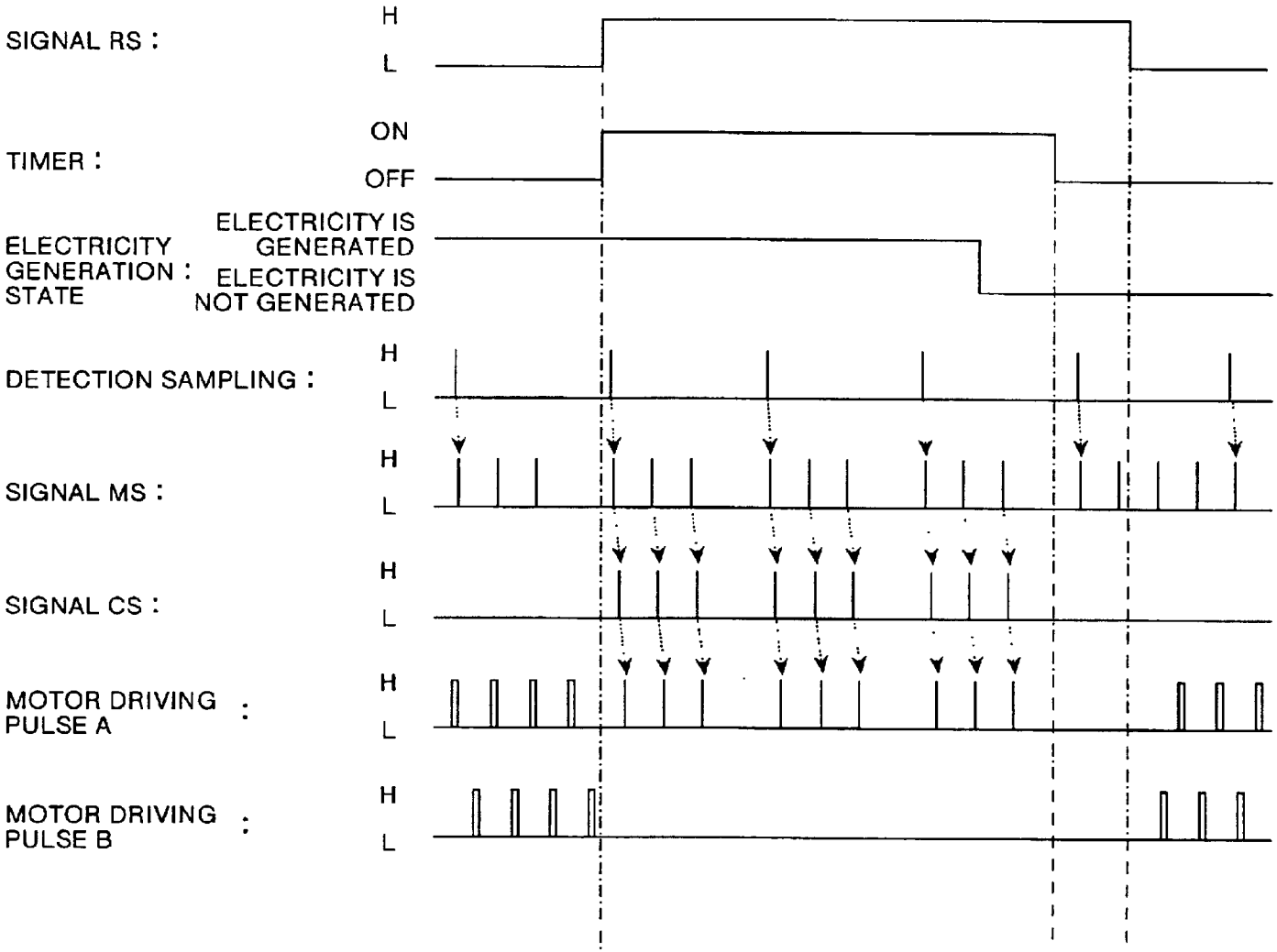
FIG. 5 is a time chart which explains the operation of the electronic watch of the third embodiment.

The operation of the electronic watch of the third embodiment will be explained below. FIG. 5 is a time chart which explains the operation of the electronic watch of the third embodiment.

The electricity generating amount detecting unit 31 outputs a number of necessary pulses in accordance with the electricity generating amount of the electricity generating unit 10 as the signal MS in one-time detection sampling. As an example here, the electricity generating amount detecting unit 31 carries out detection sampling at four-second intervals, and when the electricity generating amount of the electricity generating unit 10 satisfies the defined specification, short pulses are continuously output four times at one-second intervals in one-time detection sampling.

That is, when the electricity generating amount of the electricity generating unit 10 is at maximum, the electronic watch of the third embodiment carries out the same operation as the electronic watch of the second embodiment. The operation of the elements other than the electricity generating amount detecting unit 31 is the same as that shown in FIG. 2 and thus, only the time chart concerning the operation of the electricity generating amount detecting unit 31 will be explained.

In the above example, the electricity generating amount detecting unit 31 can express the electricity generating amount of the electricity generating unit 10 in four stages which coincide with the number of pulses. For example, when the electricity generating amount of the electricity generating unit 10 is about ¾ of the defined specification, the electricity generating amount detecting unit 31 outputs three pulses at one-second intervals as signals MS in one-time detection sampling as shown in FIG. 5.

As explained in the first embodiment, among pulses output as signals MS, only pulses belonging to a period in which the timer 13*a* is in its ON state are targets to be followed by the control unit 13, and these pulses are respectively output as the signal CS.

The signal CS is input to the narrow pulse forming unit 7 and is output as signal KS of narrow pulse, and is detected by an external device through the coil 4*a* like in the first embodiment.

After all, in this example, once detected that the electricity is generating, the external device can detect a pulse having one-second interval continuing in the number corresponding to the electricity generating amount of the electricity generating unit 10 with respect to the one-time detection. In other wards, by counting the number of pulses which are continuous at one-second intervals after the stem switch 8 is pulled out, it is possible to know the level of electricity generating amount of the electricity generating unit 10 with respect to one-time detection sampling.

Especially, it is possible to select an electronic watch having a condition that the electricity generating unit 10 is not damaged so that a predetermined amount of electricity is supplied to the storage unit 11 but the electricity generating amount is not sufficient and therefore the required specification is not satisfied.

As explained above, according to the electronic watch of the third embodiment, the effect explained in the first embodiment can be obtained, and at the same time narrow pulses (signals KS) in number required in accordance with the electricity generating amount of the electricity generating unit 10 are output to the motor driving circuit 4 with respect to one-time detection of the electricity generation. Therefore, it is possible to confirm whether the electricity generating unit 10 satisfies the predetermined specification in the external device.

As in the above example, when the number or interval of the pulses to a larger value when the electricity generating amount of the electricity generating unit 10 satisfies the defined specification, the effect shown in the second embodiment can also be obtained naturally. That is, in this case, even when the electronic watch of the third embodiment includes the thermionic element or the rotating weight as the electricity generating unit 10, it is possible to confirm the electricity generating state including the electricity generating amount in the external device.

Next, an electronic watch of the fourth embodiment will be explained. The electronic watch of the fourth embodiment based on the configuration of FIG. 1 includes a voltage detecting unit 32 which detects the voltage of the storage unit 11, and the mode is not shifted to the electricity generation confirming mode when the detected voltage is equal to or less than a predetermined value.

Figure 6:
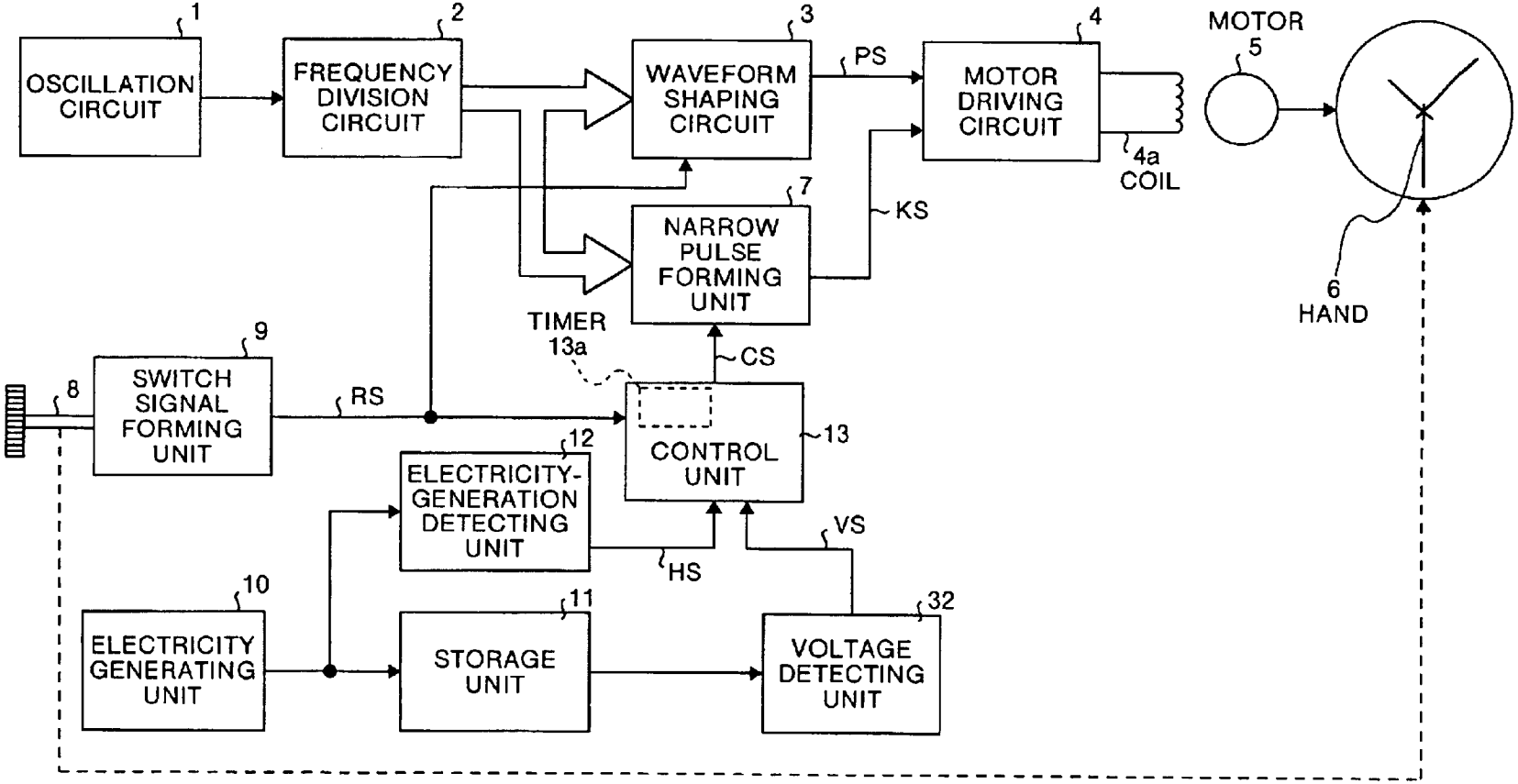
FIG. 6 is a block diagram which schematically shows a configuration of an electronic watch of a fourth embodiment.

FIG. 6 is a block diagram which schematically shows a configuration of the electronic watch of the fourth embodiment. Parts common to those shown in FIG. 1 are designated with the same symbols, and explanation thereof will be omitted. The electronic watch shown in FIG. 6 is different from that of FIG. 1 in that the voltage detecting unit 32 is added, and a signal VS is output from the voltage detecting unit 32 to the control unit 13.

Figure 7:
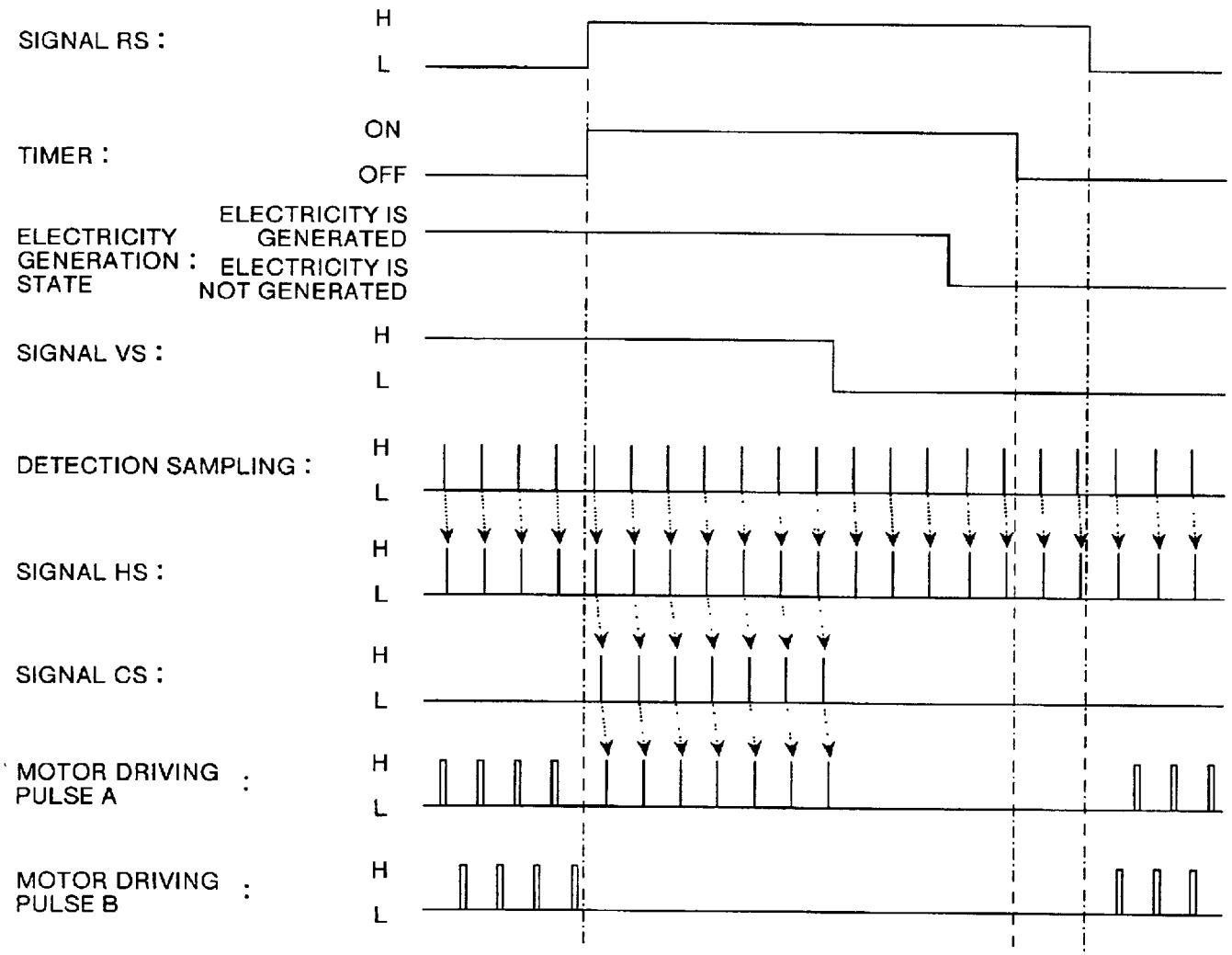
FIG. 7 is a time chart which explains the operation of the electronic watch of the fourth embodiment.

The operation of the electronic watch of the fourth embodiment will be explained below. FIG. 7 is a time chart which explains the operation of the electronic watch of the fourth embodiment.

The voltage detecting unit 32 detects whether or not the electricity amount stored in the storage unit 11 is equal to or greater than a predetermined value based on a voltage value of the storage unit 11. When the voltage of the storage unit 11 is equal to or greater than the predetermined value, the voltage detecting unit 32 outputs a signal VS at logic level "H" indicating that effect. Conversely, when the voltage of the storage unit 11 is less than the predetermined value, the voltage detecting unit 32 outputs a signal VS of logic level "L" indicating that effect.

The control unit 13 receives the signal VS. However, even when the signal RS shows the logic level "H" and it is the clocking period of the timer 13*a*, the mode is not shifted to the electricity generation confirming mode if the signal VS is at logic level "L". In other words, only when the signal RS shows the logic level "H" and it is the clocking period of the timer 13*a*, and when the signal VS is at logic level "H", the mode shifts to the electricity generation confirming mode.

Therefore, the time chart shown in FIG. 7 is different from that of FIG. 2 in that the signal VS is required to be at logic level "H" since the pulse of the signal HS detected based on detection sampling is output to the control unit 13 as the pulse of a signal CS. The operations of other constituent elements such as the narrow pulse forming unit 7 are the same as those shown in FIG. 2 and thus, explanation thereof will be omitted.

As explained above, the mode is not shifted to the electricity generation confirming mode when the storage unit 11 is low in storage of electricity, and thereby it is possible to prevent the operation of the watch from being unstable due to wasteful electricity consumption caused by shifting the mode to the electricity generation confirming mode even through the storage unit 11 is low in storage of electricity.

This especially prevents the electricity of the storage unit 11 that is low in storage from being further consumed which may be caused by shifting the mode to the electricity generation confirming mode each time the stem switch 8 is pulled out, i.e., the time is corrected after a user obtains the electronic watch.

As explained above, according to the electronic watch of the fourth embodiment, the effect explained in the first embodiment can be obtained, and at the same time the mode is not shifted to the electricity generation confirming mode when the stored electricity amount of the storage unit 11 does not reach the predetermined value. Therefore, it is possible to prevent the electricity of the storage unit 11 which is low in storage from being wastefully consumed, and it is possible to compensate for the stable clocking operation.

In the above first to fourth embodiments, the electricity-generation detecting unit 12 always carries out detection sampling irrespective of the operation state of the timer 13*a*, but it may carry out detection sampling only during the clocking period of the timer 13*a*.

In the fourth embodiment, the electricity-generation detecting unit 12 may carry out detection sampling only when the signal VS is at logic level "H".

Next, an electronic watch of a fifth embodiment will be explained. The electronic watch of the fifth embodiment is such that the mode is shifted to the electricity generation confirming mode when a non-electricity generating state is brought to the electricity generating state instead of a pull-out state of the stem switch.

Figure 8:
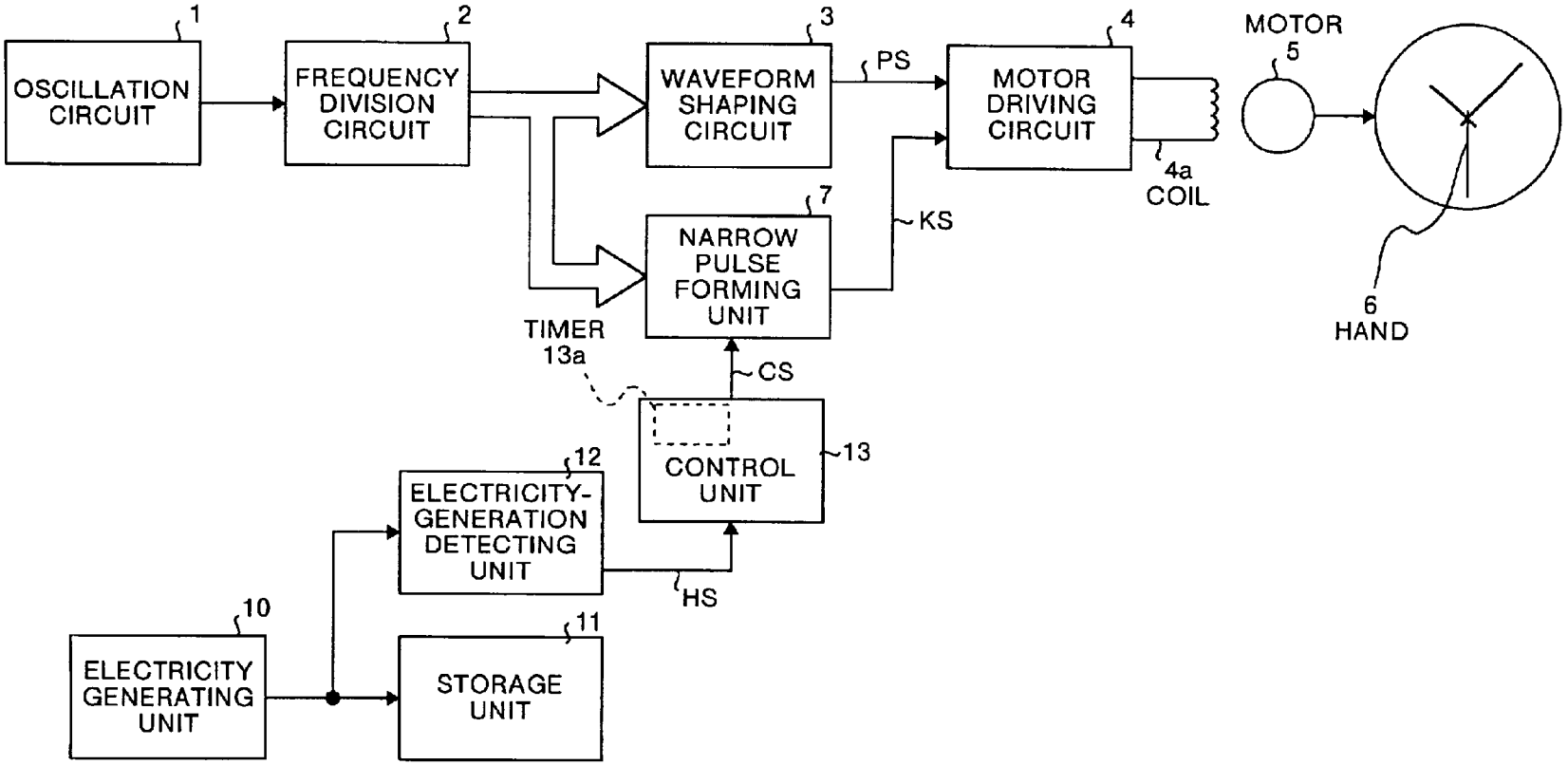
FIG. 8 is a block diagram which schematically shows a configuration of an electronic watch of a fifth embodiment.

FIG. 8 is a block diagram which schematically shows a configuration of the electronic watch of the fifth embodiment. Parts common to those shown in FIG. 1 are designated with the same symbols, and explanation thereof will be omitted. This electronic watch shown in FIG. 8 is different from that of FIG. 1 in that the switch signal forming unit 9 is eliminated.

Figure 9:
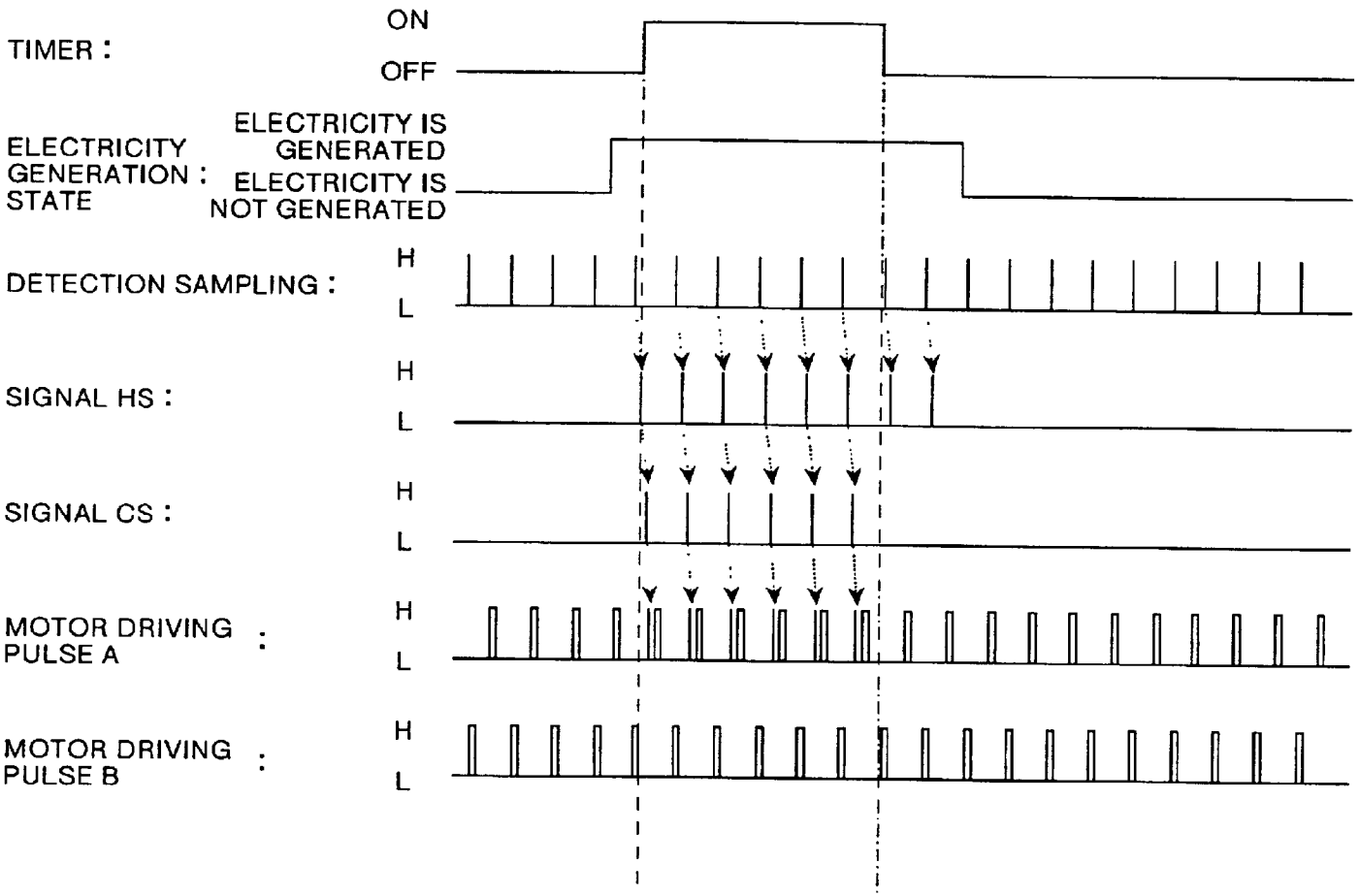
FIG. 9 is a time chart which explains the operation of the electronic watch of the fifth embodiment.

The operation of the electronic watch of the fifth embodiment will be explained below. FIG. 9 is a time chart which explains the operation of the electronic watch of the fifth embodiment.

In the time chart shown in FIG. 2, the clocking of the timer 13*a* is started when the pulling out of the stem switch 8 is detected and the signal RS at logic level "H" is input to the control unit 13. Whereas, in the time chart shown in FIG. 9, the clocking of the timer 13*a* is started when the electricity generating unit 10 is brought to the electricity generating operation, i.e., the time when a signal HS of a short pulse output by the electricity-generation detecting unit 12 is input to the control unit 13 being the trigger. At that time, however, outputs of motor driving pulse A and motor driving pulse B are not stopped, and the hand-moving pulses (rectangular pulses in the figure) are output even when the mode is brought to the electricity generation confirming mode. Therefore, as shown in FIG. 9, the hand-moving pulse is output to the motor driving circuit 4 together with the electricity-generation detecting signal (line pulse in the figure) during a period when the electricity generation is confirmed in the electricity generation confirming mode. Other operations are the same as those shown in FIG. 2.

As explained above, according to the electronic watch of the fifth embodiment, the effect explained in the first embodiment can be obtained, and at the same time, detection of the electricity generating operation is used as a trigger to transfer to the electricity generation confirming mode. Therefore, the switch signal forming unit 9 as shown in FIG. 1 becomes unnecessary.

Next, an electronic watch of a sixth embodiment will be explained. The electronic watch of the sixth embodiment is such that the time is corrected with a push switch and the electricity generation can be confirmed in an electronic watch of a specification in which the time is indicated in an analogue manner using an hour hand and a minute hand (no second hand).

Usually, the electronic watch of the above specification has no second hand, and therefore the minute hand is rotated with hand-moving pulses formed at ten-second intervals. Therefore, even when the output state of the hand-moving pulse, i.e., even when current flowing through the coil of the motor which rotates the hand is detected by the external device, a rate in several second unit can not be detected. Thereupon, the electronic watch of the above specification includes a rate pulse forming unit which forms a rate pulse of several-seconds intervals so that the rate can be detected, and fine current based on the rate pulse is flown through the coil of the motor.

Figure 10:
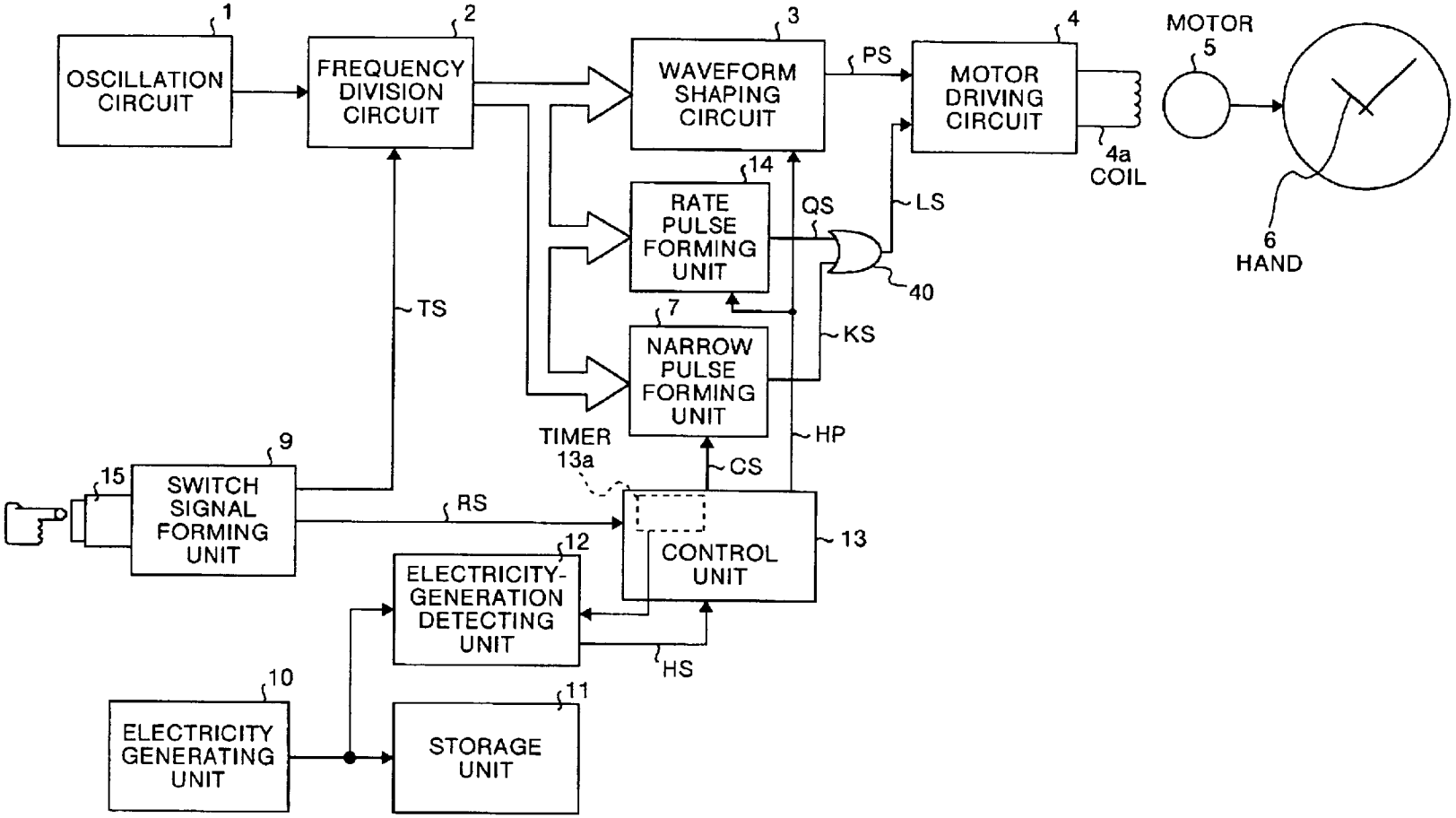
FIG. 10 is a block diagram which schematically shows a configuration of an electronic watch of a sixth embodiment.

FIG. 10 is a block diagram which schematically shows a configuration of the electronic watch of the sixth embodiment. In FIG. 10, parts common to those shown in FIG. 1 are designated with the same symbols, and explanation thereof will be omitted. This electronic watch shown in FIG. 10 is different from that of FIG. 1 in that the electronic watch is provided with a push switch 15 instead of the stem switch 8, a rate pulse forming unit 14 which forms a rate pulse based on a clock signal output from the frequency division circuit 2, and an OR circuit 40 which calculates logical operation OR between the rate pulse (signal QS) and a narrow pulse (signal KS) output from the narrow pulse forming unit 7, and that the signal LS output from the OR circuit 40 is input to the motor driving circuit 4.

A signal HP indicative of transfer to a quick correcting mode is output from the control unit 13 to the waveform shaping circuit 3. "Quick correction" here is a usually possible operation in an electronic watch of a specification in which the time is corrected with a push switch, and the hand 6 can be rotated continuously by keeping pushing the push switch for a predetermined time.

Figure 11:
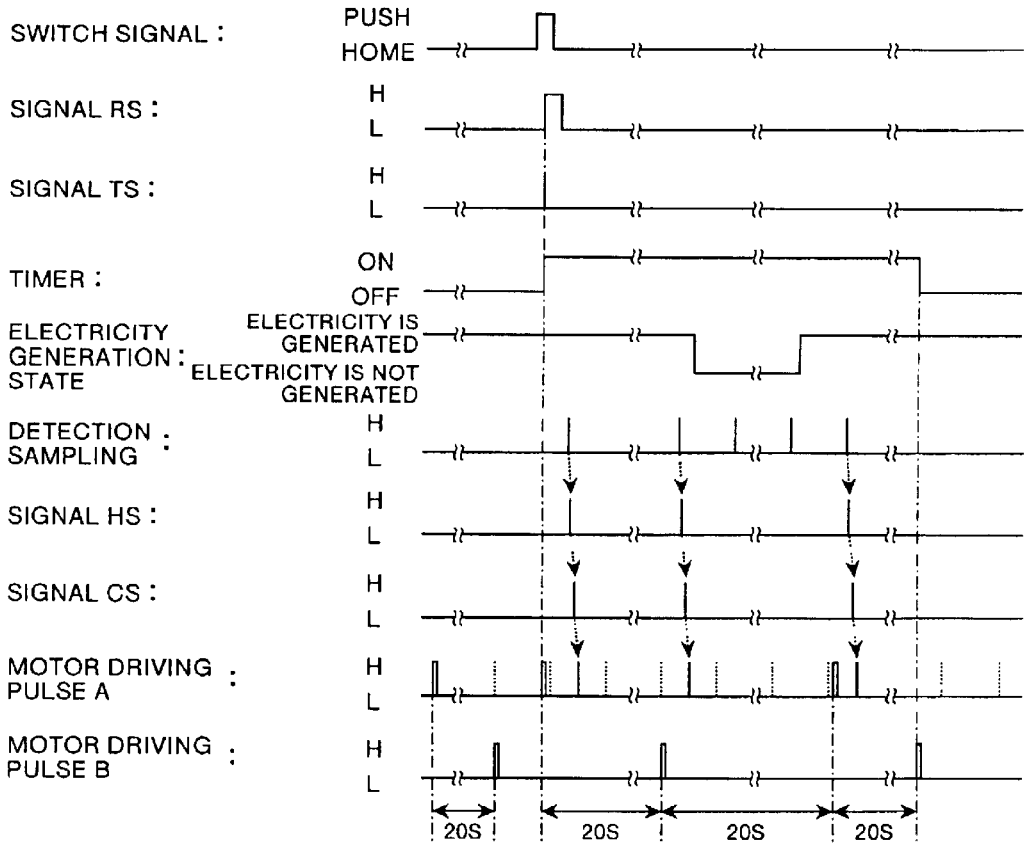
FIG. 11 is a time chart which explains the operation of the electronic watch of the sixth embodiment at the time of normal operation.

The operation of the electronic watch of the sixth embodiment will be explained below. FIG. 11 is a time chart which explains the operation of the electronic watch of the sixth embodiment, and which especially explains such a case when the mode is brought to the electricity generation confirming mode in an operation of normally correcting the time instead of the quick correction.

The electricity-generation detecting unit 12 does not generally confirm the presence or absence of electricity generation of the electricity generating unit 10, and does not output the signal HS of short pulse as explained in the first embodiment even when the electricity generating unit 10 is in its generating state.

When the push switch 15 is in its home position, the waveform shaping circuit 3 alternately outputs two pulses based on the specification of the above electronic watch so that the interval of the two pulses becomes 20 seconds, for example, and the two pulses have a predetermined pulse width. Here, a pulse which energizes the coil 4*a* in one direction is defined as a motor driving pulse A (rectangular pulse in the figure), and a pulse which energizes the coil 4*a* in the other direction is defined as a motor driving pulse B (rectangular pulse in the figure). The signal PS shown in FIG. 1 corresponds to the motor driving pulse A and the motor driving pulse B, i.e., the hand-moving pulses.

The motor driving circuit 4 switches the energizing direction of the coil 4*a* alternately based on the hand-moving pulse, and rotates the motor 5. The rotation of the motor 5 allows the hand 6 to rotate every 20 seconds, i.e., the minute hand to move every two degrees each time through a wheel train not shown.

The rate pulse forming unit 14 receives the clock signal output from the frequency division circuit 2, forms a rate pulse of two-second intervals of narrow width like that of the narrow pulse forming unit 7, and outputs the formed rate pulse as a signal QS. The signal QS is input to the motor driving circuit 4 through the OR circuit 40 irrespective of the presence or absence of the signal KS output from the narrow pulse forming unit 7. Therefore, the rate pulse can be detected by the external device like the narrow pulse.

In this state, when the push switch 15 is pushed down for a short time period through general pushing operation of the switch, the switch signal forming unit 9 outputs a pulse of a predetermined width as the signal RS and outputs a signal TS of a short pulse (line pulse in the figure).

The signal RS of the pulse output from the switch signal forming unit 9 is input to the control unit 13, and the control unit 13 starts clocking by the timer 13*a* in synchronization with rising edge of the signal RS. Simultaneously with the start of clocking of the timer 13*a*, the control unit 13 outputs a signal indicating a request to detect the electricity generation through detection sampling to the electricity-generation detecting unit 12.

On the other hand, the signal TS of the pulse output from the switch signal forming unit 9 is input to the frequency division circuit 2, and the frequency division circuit 2 resets the clock signal in synchronization with the rising edge of the signal TS. The wave form shaping circuit 3 outputs a hand-moving pulse for correction at this timing, and continuously outputs the hand-moving pulses from this resetting time as a new starting time point.

The rate pulse forming unit 14 starts outputting the signal QS of the rate pulse after a predetermined time from the above resetting timing.

When the control unit 13 receives a signal HS of short pulse indicating that electricity is being generated from the electricity-generation detecting unit 12 during the clocking period by the timer 13*a*, i.e., in the electricity generation confirming mode, the control unit 13 outputs a short pulse (line pulse in the figure) which follows the signal HS, as the signal CS.

The narrow pulse forming unit 7 generates a pulse having a smaller width than that of the hand-moving pulse, especially a pulse having a smaller width than that of a pulse width which is necessary to drive the motor 5 in the motor driving circuit 4, and outputs the generated pulse as the signal KS. Especially, this narrow pulse (line pulse indicated with a solid line in the figure) is adjusted so that it is output in the vicinity of an intermediate point of the output interval of the above-mentioned rate pulse (line pulse indicated with a dotted line in the figure). For example, the output timing of the narrow pulse is determined so that the output interval between the rate pulse and the narrow pulse becomes one second.

The signal QS and signal KS are synthesized in a time series manner in the OR circuit 40, and the synthesized signal is output as the signal LS.

When receiving the signal LS, the motor driving circuit 4 flows fine current of the rate pulse and narrow pulse included in the signal LS through the coil 4*a*, but the motor 5 is not rotated by these pulses, and the hand 6 is not moved either. Although the signal QS of the rate pulse and the signal KS of the narrow pulse are indicated as being input as the motor driving pulse A in FIG. 11, these two signals may be input as the motor driving pulse B.

Since the fine current flowing through the coil 4*a* causes a fine variation in a magnetic field of the coil 4*a*, the signal QS of the rate pulse and the signal KS of narrow pulse can be detected indirectly through detection of the variation by an external device. That is, it is possible to recognize, from outside the electronic watch, whether the electricity generating unit 10 is generating electricity, which means that it is possible to check the operation of the electricity generating unit 10 for a product in a completed form. Especially, even if the external device can not distinguish the rate pulse from the narrow pulse, it is possible to easily confirm whether or not the electricity generating unit 10 is operating because the detection interval of the pulses becomes smaller through synthesis of the rate pulse to the narrow pulse during the electricity generating operation.

When a timeout occurs in the timer 13*a*, the control unit 13 outputs a signal indicating that detection of electricity generation performed based on detection sampling is stopped, to the electricity-generation detecting unit 12.

The reason why the timer 13*a* is provided is to prevent wasteful electricity consumption as explained in the first embodiment.

Figure 12:
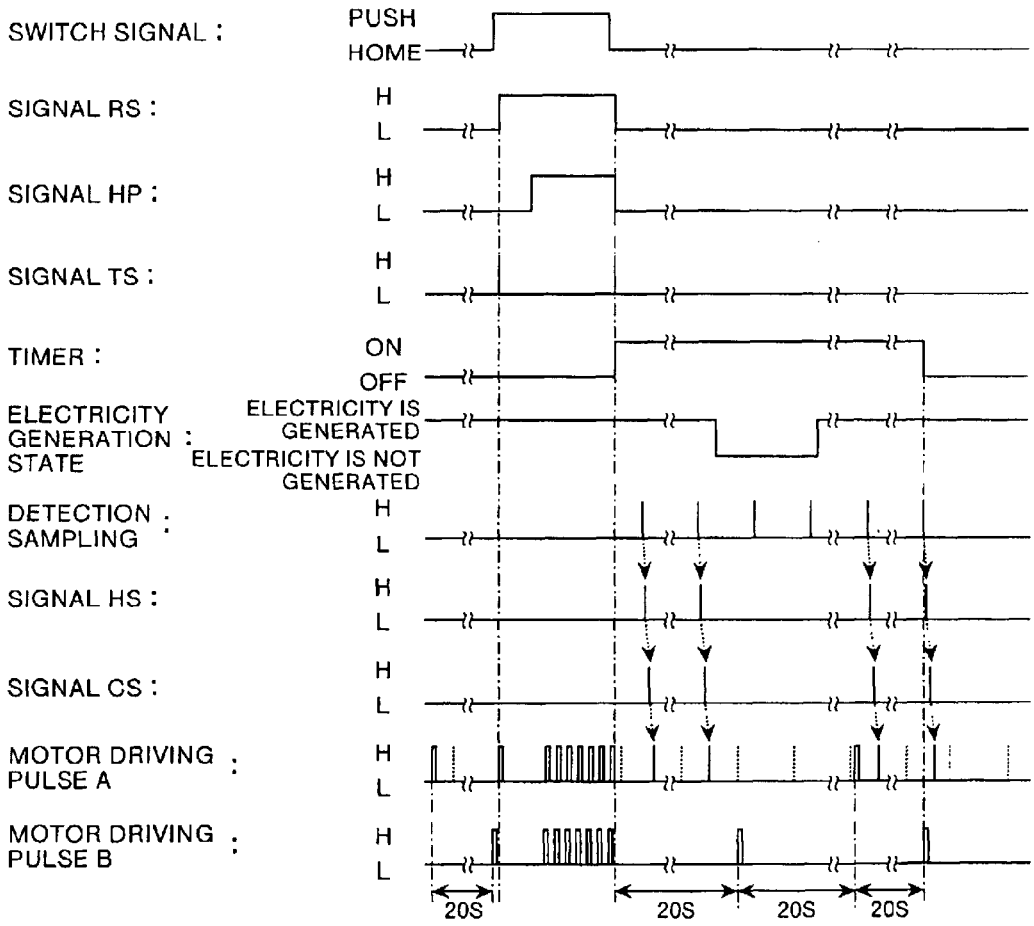
FIG. 12 is a time chart which explains the operation of the sixth embodiment at the time of quick correcting operation.

Next, confirmation of electricity generation at the time of quick correction of the electronic watch according to the sixth embodiment will be explained. FIG. 12 is a time chart which explains the operation of the electronic watch of the sixth embodiment, and which especially explains such a case where the mode is shifted to the electricity generation confirming mode in the time correction operation at the time of quick correction.

The quick correcting operation, i.e., transfer to the quick correcting mode, is carried out when the push switch 15 is pushed down for a relatively longer time period than the ordinary switch pushing operation. As shown in FIG. 12, when the state of pushing down the push switch 15, i.e., the logic level "H" of the signal RS is continued for a predetermined period or longer, the control unit 13 outputs a signal HP at logic level "H" indicating the quick correcting mode to the waveform shaping circuit 3 and the rate pulse forming unit 14.

The waveform shaping circuit 3 generates hand-moving pulses of small output interval during the period in which the signal HP indicates the logic level "H", and outputs the generated pulses to the motor driving circuit 4. The motor driving circuit 4 continuously rotates the hand 6 in accordance with the hand-moving pulses of smaller output interval.

On the other hand, since the output timing of the hand-moving pulse at the time of quick correction and the output timing of the rate pulse overlap, the rate pulse forming unit 14 stops the output of the rate pulse during a period in which the signal HP indicates the logic level "H".

When the quick correcting operation is completed by returning the push switch 15 to its home position, the signal HP returns to the logic level "L", and the signal TS of the short pulse (line pulse in the figure) is output from the switch signal forming unit 9 to the frequency division circuit 3. This signal TS is a signal which resets the frequency division circuit 3 as described above, and the mode is shifted to the electricity generation confirming mode shown in FIG. 11 with the reset signal as a trigger.

The operation in the electricity generation confirming mode is as explained in FIG. 11 and thus, explanation thereof will be omitted.

As explained above, according to the electronic watch of the sixth embodiment, the effect explained in the first embodiment can be obtained even in an electronic watch which includes the rate pulse forming unit 14 and in which the time is corrected through operation of a push switch type switch capable of quick correcting.

Next, an electronic watch according to a seventh embodiment will be explained. The electronic watch of the seventh embodiment is such that a second push switch is added to the electronic watch shown in FIG. 10, the clocking of the timer 13*a* is ended by pushing down the second push switch, and electricity generation confirming mode is forcibly ended.

Figure 13:
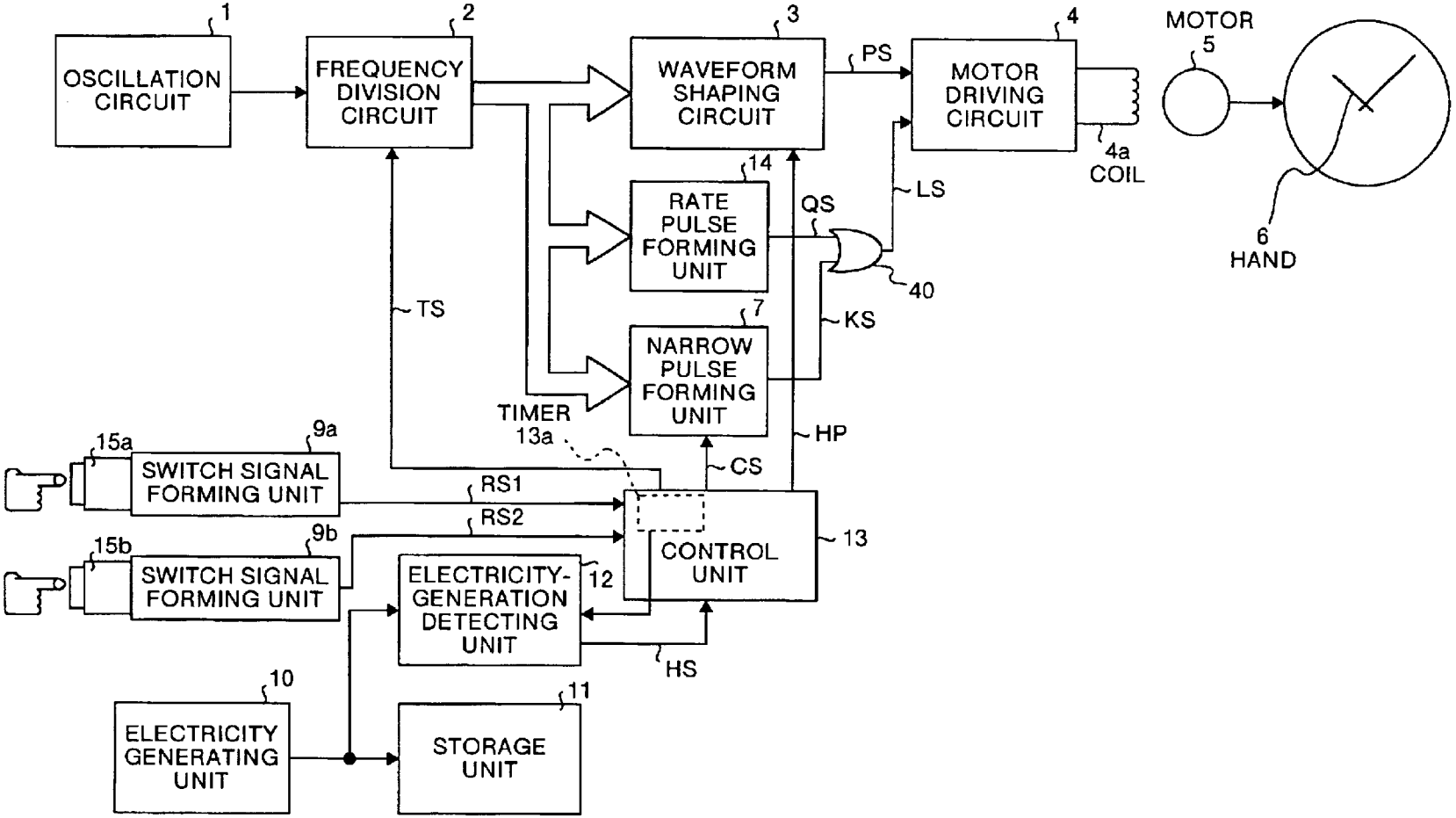
FIG. 13 is a block diagram which schematically shows a configuration of an electronic watch of a seventh embodiment.

FIG. 13 is a block diagram which schematically shows a configuration of the electronic watch of the seventh embodiment. In FIG. 13, parts common to those shown in FIG. 10 are designated with the same symbols, and explanation thereof will be omitted. This electronic watch shown in FIG. 13 is different from that of FIG. 10 in that a push switch 15*b* is included in addition to a push switch 15*a* corresponding to the push switch 15, and a switch signal forming unit 9*b* is provided in addition to a switch signal forming unit 9*a* corresponding to the switch signal forming unit 9.

Figure 14:
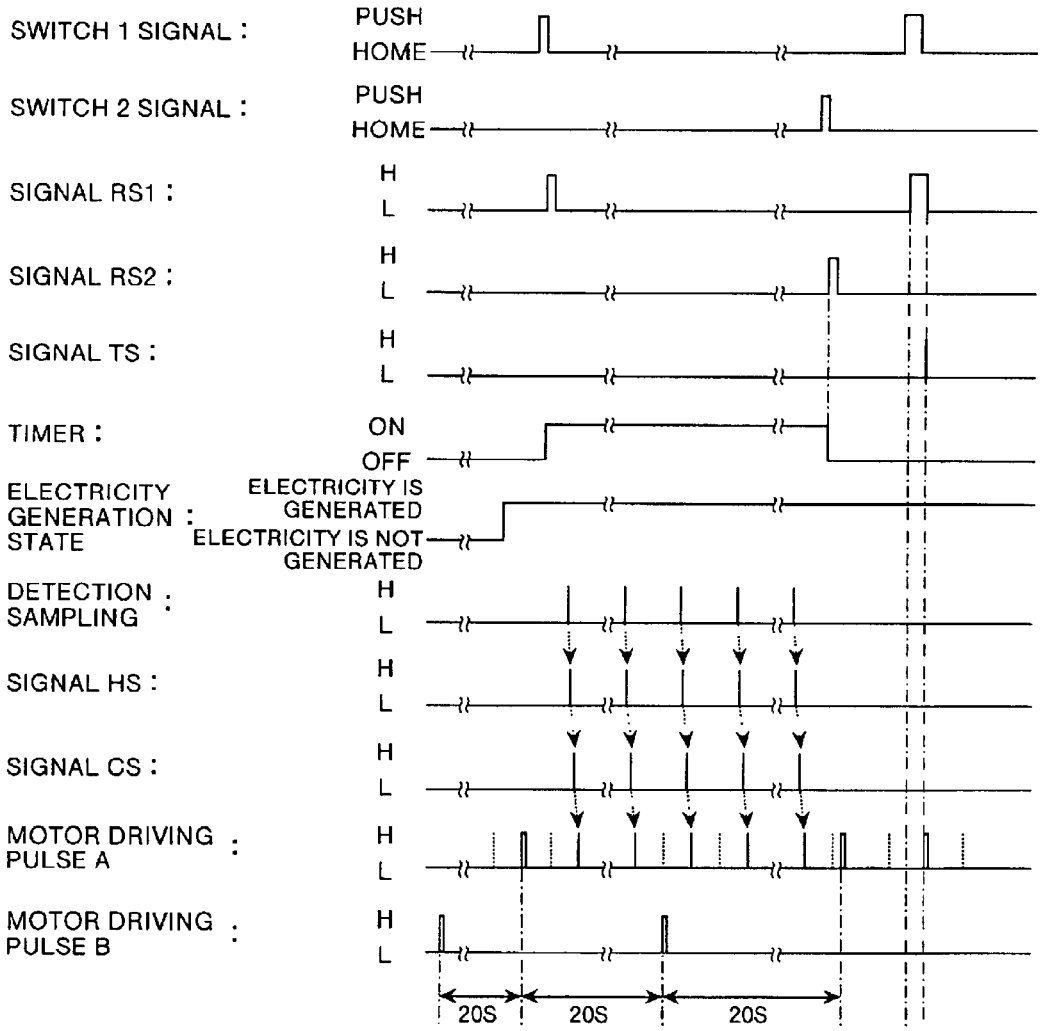
FIG. 14 is a time chart which explains the operation of the electronic watch of the seventh embodiment.

The operation of the electronic watch of the seventh embodiment will be explained below. FIG. 14 is a time chart which explains the operation of the electronic watch of the seventh embodiment. In the electronic watch of the sixth embodiment, the mode is shifted to the electricity generation confirming mode when the time of pushing down the switch used commonly for the time correcting operation reaches a certain time. However, the electronic watch of the seventh embodiment is such that the mode is shifted to the electricity generation confirming mode when the time of pushing down the push switch 15*a* is shorter than the ordinary time of pushing it down.

In FIG. 14, a different point from FIG. 11 is that the control unit 13 is brought to the electricity generation confirming mode, i.e., the clocking of the timer 13*a* is started on condition that the pulse width of a signal RS1 output from the switch signal forming unit 9*a* is smaller than a predetermined width.

Since the operation during the clocking period of the timer 13*a* is as shown in FIG. 11, explanation thereof will be omitted. When a timeout occurs in the timer 13*a*, the control unit 13 outputs a signal indicating that the detection of electricity generation performed based on detection sampling is stopped, to the electricity-generation detecting unit 12. This point is common to that of FIG. 11.

However, when the push switch 15*b* is pushed down during the clocking period previously set in the timer 13*a*, the control unit 13 receives a signal RS2 which is a signal indicating pushing down the switch, and forcibly ends the clocking operation of the timer 13*a* to end the electricity generation confirming mode.

As explained above, by distinguishing the switch operation to transfer to the electricity generation confirming mode from the time correcting operation, it is possible to avoid such an incident that electricity required for confirming the electricity generation is consumed whenever the time is corrected. Conversely, when the mode is brought into the electricity generation confirming mode like the sixth embodiment, it is also possible to avoid a problem that the time is changed due to output of a hand-moving pulse at least one time.

When the push switch 15*a* is pushed down for a predetermined period or longer to transfer to the operation of correcting the time during a period other than the clocking period of the timer 13*a*, i.e., when a pulse width of the signal RS1 output from the switch signal forming unit 9*a* is equal to or greater than a predetermined width, the control unit 13, as shown in FIG. 14, outputs a signal TS of short pulse in synchronization with rising edge of the signal RS1 to reset the frequency division circuit 3, and in association with the output, the waveform shaping circuit 3 outputs a hand-moving pulse which corrects the time.

As explained above, according to the electronic watch of the seventh embodiment, the effect explained in the sixth embodiment can be obtained, and at the same time the transfer of the electricity generation confirming mode is clearly distinguished from the time correcting operation. Therefore, the hand is prevented from being moved unintentionally when the electricity generation is confirmed, and it is also possible to prevent wasteful consumption of electricity immediately after the confirmation of the electricity generation.

Next, an electronic watch of an eighth embodiment will be explained. The electronic watch of the eighth embodiment is such that the electronic watch of the specification explained in the sixth embodiment forcibly ends the electricity generation confirming mode when the quick correcting operation is carried out while the mode is shifted to the electricity generation confirming mode, and that the mode is not brought into the electricity generation confirming mode within a predetermined time immediately after the quick correcting operation is completed.

Figure 15:
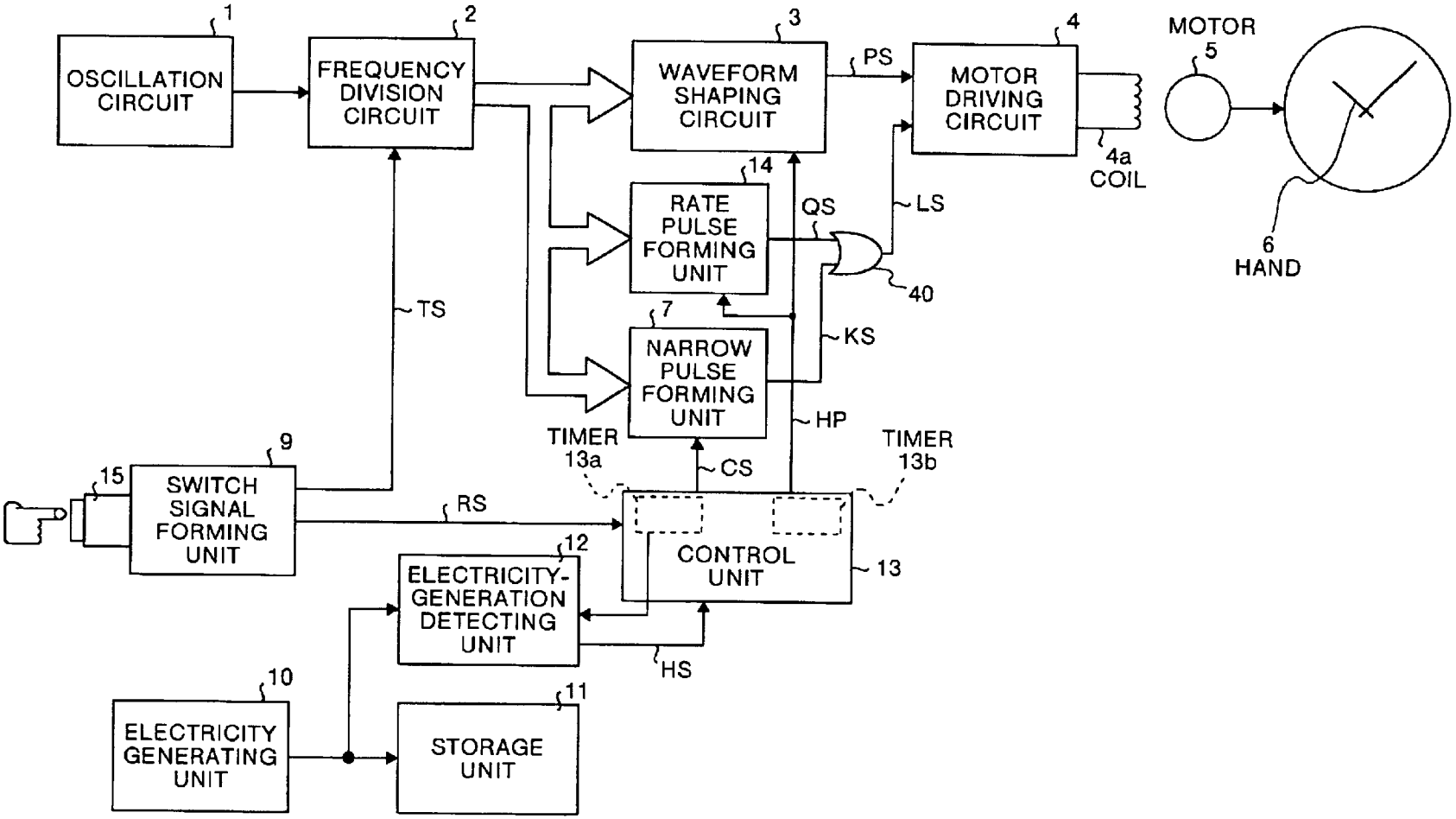
FIG. 15 is a block diagram which schematically shows a configuration of an electronic watch of an eighth embodiment.

FIG. 15 is a block diagram which schematically shows a configuration of the electronic watch of the eighth embodiment. In FIG. 15, parts common to those of FIG. 10 are designated with the same symbols, and explanation thereof will be omitted. The electronic watch shown in FIG. 15 is different from that of FIG. 10 in that a timer 13*b* which starts clocking at the same time when the quick correcting operation is completed is provided in the control unit 13 as a second timer.

Figure 16:
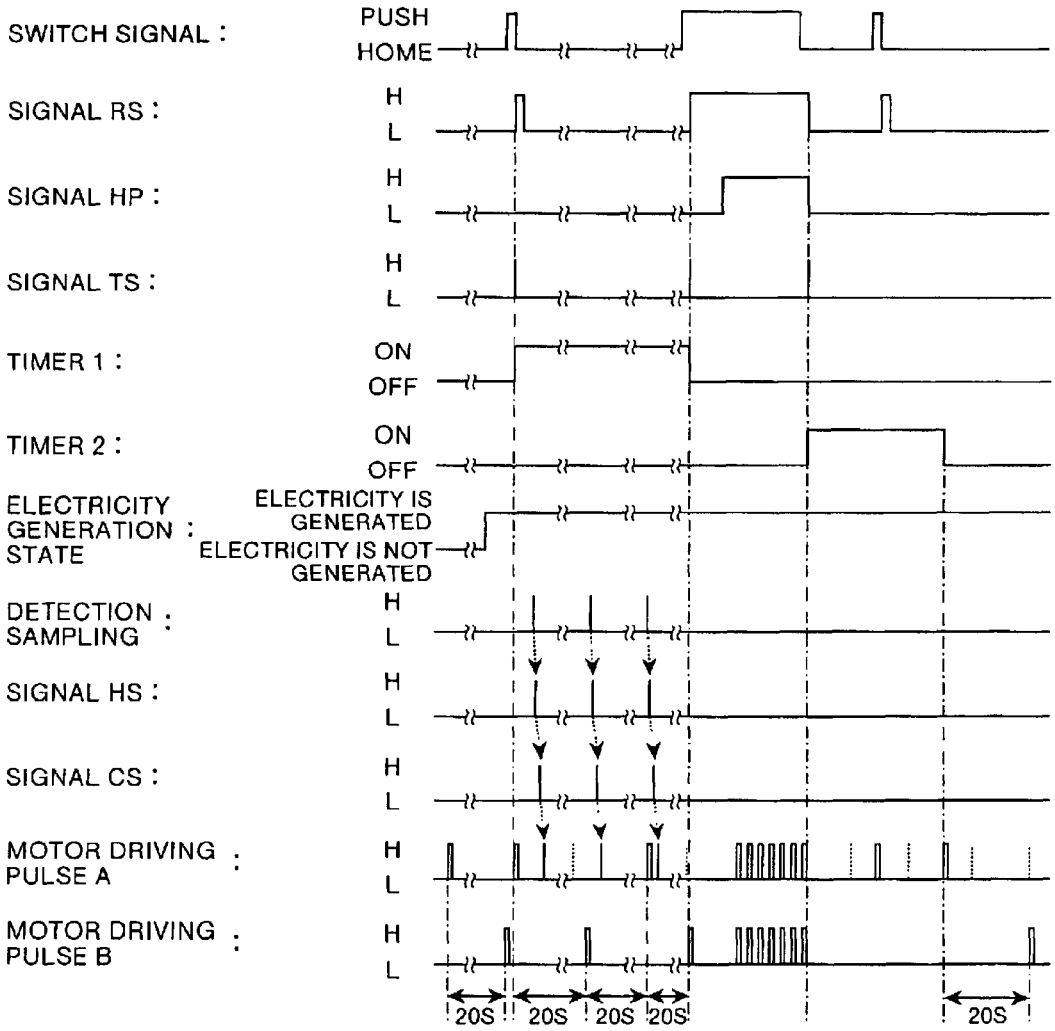
FIG. 16 is a time chart which explains the operation of the electronic watch of the eighth embodiment.

The operation of the electronic watch of the eighth embodiment will be explained below. FIG. 16 is a time chart which explains the operation of the electronic watch of the eighth embodiment. Especially, this time chart shows the combined operations corresponding to those in FIG. 11 and FIG. 12.

In the flowchart shown in FIG. 16, the difference from that shown in FIGS. 11 and 12 is that when the quick correcting operation is carried out during the electricity generation confirming mode, i.e., during the clocking period of the timer 13*a* expressed as a timer 1 in FIG. 16, the clocking of the timer 13*a* is forcibly ended, and that when the quick correcting operation is ended, e.g., in a falling edge of the signal HP, the clocking of the timer 13*b* expressed as a timer 2 in FIG. 16 is started. During the clocking period of the timer 13*b*, even when the switch 15 is pushed down again, the detection sampling is not carried out by the electricity-generation detecting unit 12, and the mode is not shifted to the electricity generation confirming mode.

The reason why the mode is not shifted to the electricity generation confirming mode during a predetermined period immediately after the quick correcting operation is completed is that it is rare to complete the time correction with one quick correcting operation. Most of the time correction is executed by repeating the normal time correcting operation which is not the quick correction shown in FIG. 11*a* plurality of times and repeating the quick correcting operation shown in FIG. 12*a* plurality of times, respectively. That is, there is a high possibility that the time correcting operation is carried out again immediately after the completion of the quick correcting operation, and there is a low possibility that the confirmation of electricity generation is required. Therefore, there is a high possibility that the electricity is wastefully consumed when the mode is shifted to the electricity generation confirming mode by an operation which is common to the time correction immediately after the completion of the quick correcting operation. Thereupon, in the electronic watch of the eighth embodiment, only the time correction by the output of the hand-moving pulse is operated even when the push switch 15 is pushed down during the predetermined period immediately after the completion of the quick correcting operation.

As explained above, according to the electronic watch of the eighth embodiment, when the quick correcting operation is carried out while the mode is shifted to the electricity generation confirming mode, the electricity generation confirming mode is forcibly ended, and thereby the mode can not be brought into the electricity generation confirming mode during the predetermined time even after the completion of the quick correcting operation. Therefore, it is possible to prevent electricity from being consumed due to confirming operation of the electricity generation at the time of shifting the mode to the electricity generation confirming mode other than the case where the electricity generation is intentionally confirmed.

An electronic watch of a ninth embodiment will be explained below. The electronic watch of the ninth embodiment is such that a hand-moving mode of the hand instead of the narrow pulse is changed to confirm the presence or absence of the electricity generating operation.

Figure 17:
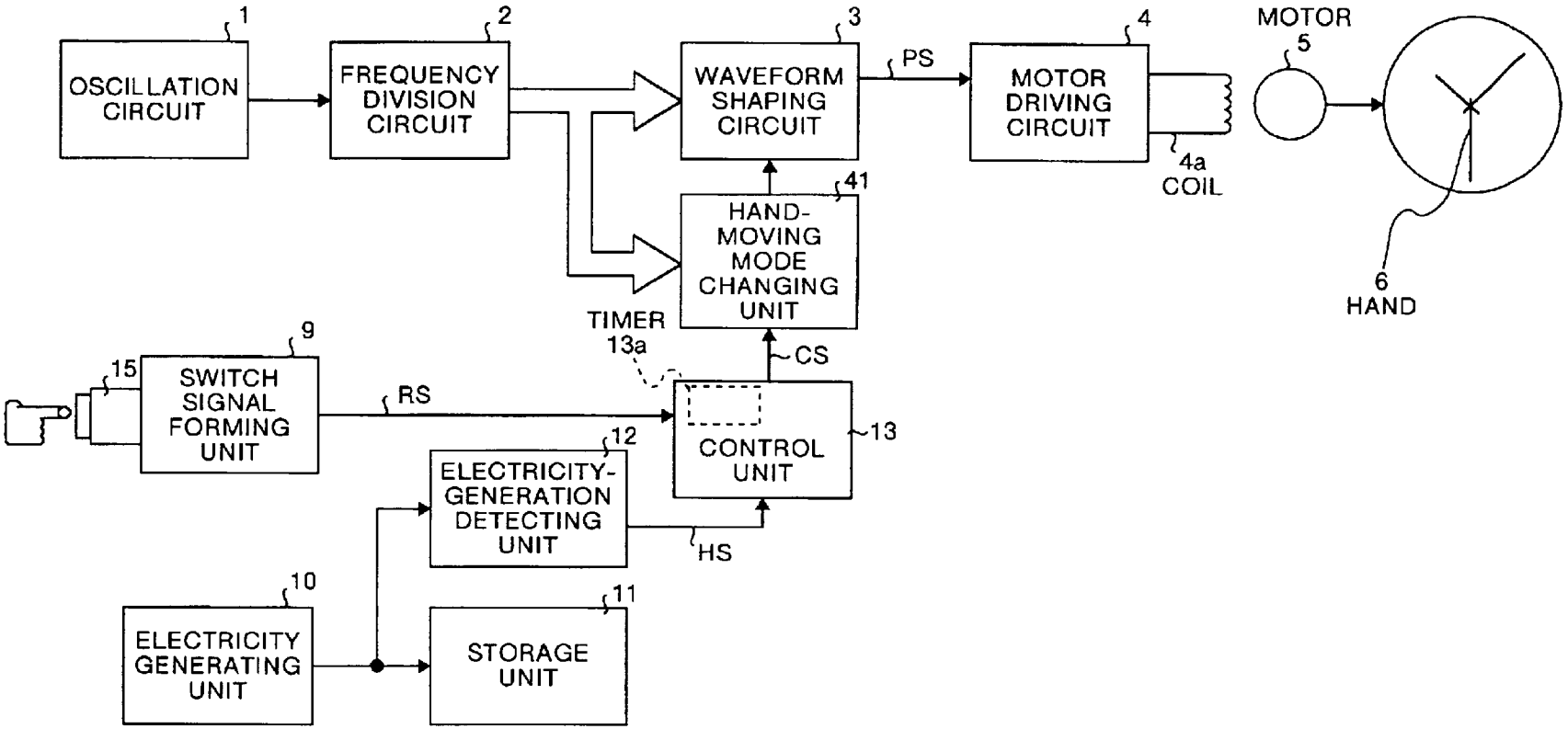
FIG. 17 is a block diagram which schematically shows a configuration of an electronic watch of a ninth embodiment.

FIG. 17 is a block diagram which schematically shows a configuration of the electronic watch of the ninth embodiment. In FIG. 17, parts common to those shown in FIG. 1 are designated with the same symbols, and explanation thereof will be omitted. The electronic watch shown in FIG. 17 is different from that of FIG. 1 in that a push switch 15 is provided instead of the stem switch 8 and a hand-moving mode changing unit 41 is provided instead of the narrow pulse forming unit 7.

The hand-moving mode changing unit 41 outputs a signal indicating that an output timing of the hand-moving pulse is changed to the waveform shaping circuit 3, based on a signal CS received from the control unit 13.

Figure 18:
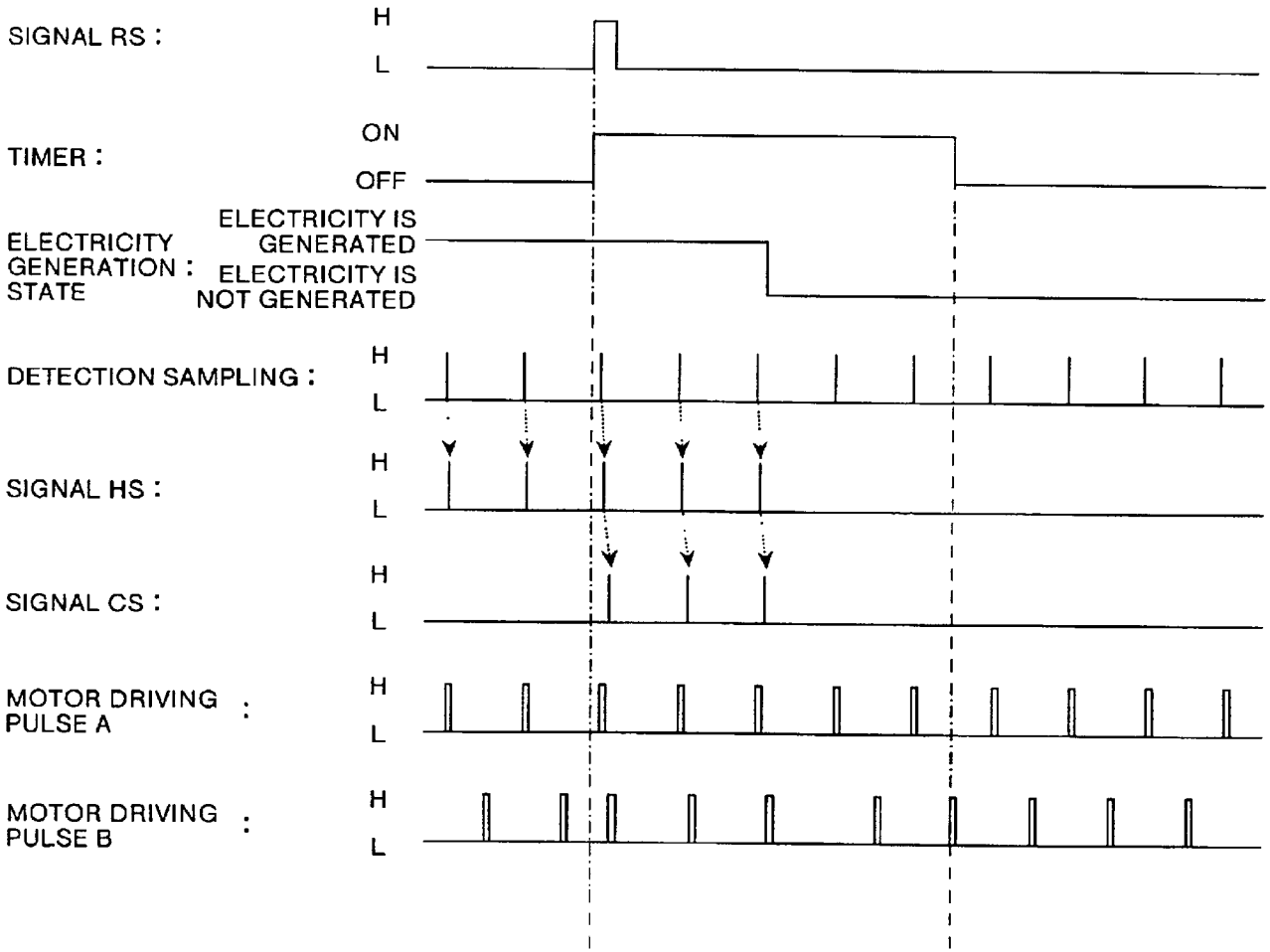
FIG. 18 is a time chart which explains the operation of the electronic watch of the ninth embodiment.

The operation of the electronic watch of the ninth embodiment will be explained below. FIG. 18 is a time chart which explains the operation of the electronic watch of the ninth embodiment. Here, the electricity-generation detecting unit 12 always carries out the detection sampling irrespective of the operation state of the timer 13*a*.

First, when the push switch 15 is pushed down for a short period through an ordinary switch pushing operation, the switch signal forming unit 9 outputs a pulse of a predetermined width as a signal RS.

The signal RS of the pulse output from the switch signal forming unit 9 is input to the control unit 13, which starts clocking by the timer 13*a* in synchronization with the rising edge of the signal RS.

When receiving the signal HS of short pulse indicating the electricity generating state from the electricity-generation detecting unit 12 during the clocking period by the timer 13*a*, i.e., in the electricity generation confirming mode, the control unit 13 outputs a short pulse (line pulse in the figure) that follows the signal HS as a signal CS.

The hand-moving mode changing unit 41 receives the signal CS of short pulse, and outputs a signal indicating that the output timing of the hand-moving pulse is changed to a predetermined timing, to the waveform shaping circuit 3. More specifically, as shown in FIG. 18, the output timing of the hand-moving pulse to be output as the motor driving pulse A is not changed, but an output timing of the hand-moving pulse to be output as the motor driving pulse B is changed so that the timing is positioned immediately after outputting of the hand-moving pulse as the motor driving pulse A not after one second since the hand-moving pulse is output as the motor driving pulse A. In the actual hand-moving mode, a second hand is rotated for two seconds (12 degrees) per one second visually.

When a timeout occurs in the timer 13*a*, the control unit 13 outputs a signal indicating that the output timing of the hand-moving pulse is returned to the normal timing, to the waveform shaping circuit 3. With this signal, the waveform shaping circuit 3 restarts continuous outputting of the hand-moving pulses at one-second intervals in a normal manner.

As explained above, according to the electronic watch of the ninth embodiment, the electricity-generation detecting unit 12 is provided and the hand-moving mode of the hand 6 is changed based on the electricity-generation detecting signal (signal HS), and it is thereby possible to confirm whether the electricity generating unit 10 is normally operating even in a state of a completed product mode. Especially in this mode, any particular external device is not required to confirm the electricity generating state, and therefore any kind of unit can be used as the electricity generating unit 10.

In the ninth embodiment, the electricity-generation detecting unit 12 always carries out detection sampling irrespective of the operating state of the timer 13*a*, but the detection sampling may be carried out only for the clocking period of the timer 13*a*.

Next, an electronic watch of a tenth embodiment will be explained. The electronic watch of the tenth embodiment has a circuit which limits the stored electricity amount of the storage unit 11, and brings this circuit into a non-operative state during detection of electricity generation.

Figure 19:
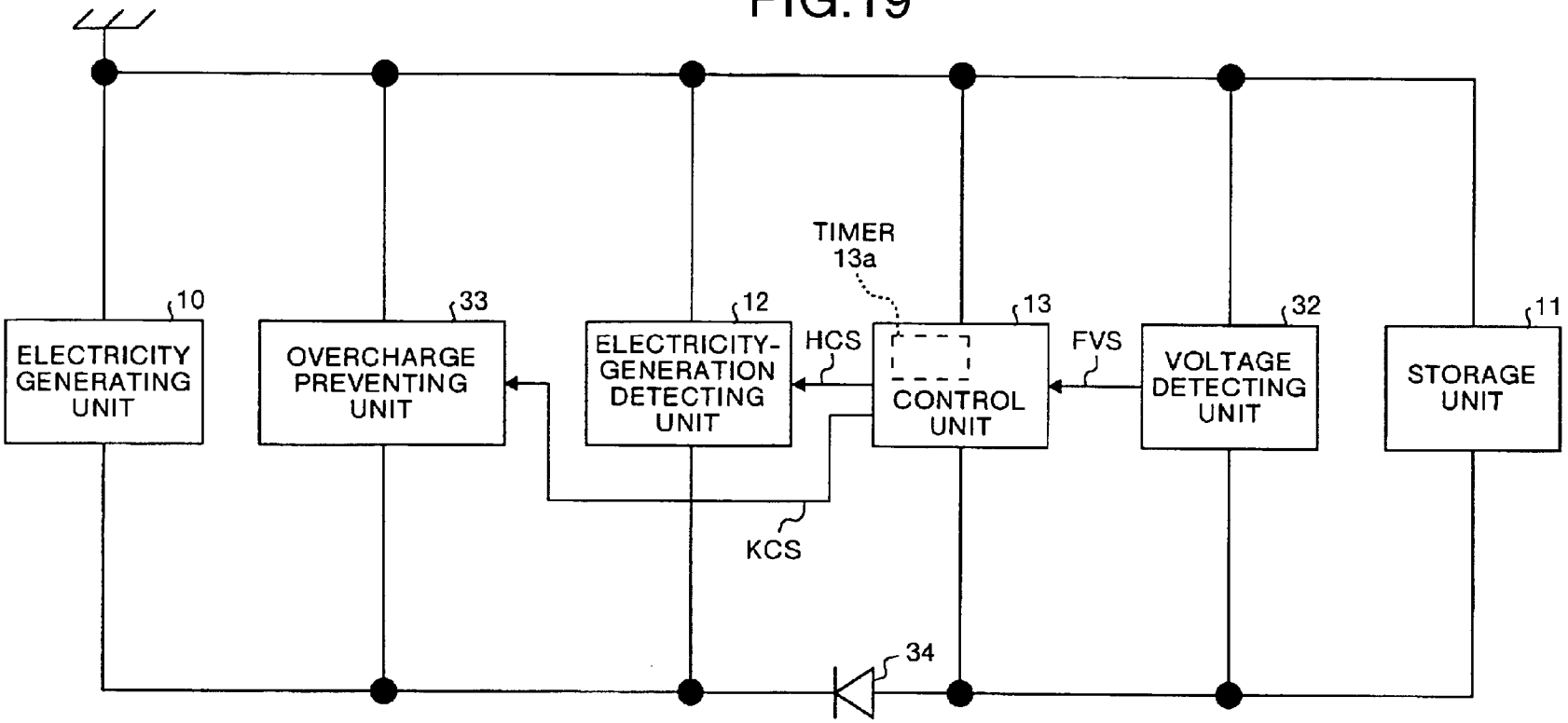
FIG. 19 is a block diagram which schematically shows a configuration of an electronic watch of a tenth embodiment.

FIG. 19 is a block diagram which schematically shows a configuration of the electronic watch of the tenth embodiment. In FIG. 19, parts common to those shown in FIG. 6 are designated with the same symbols, and explanation thereof will be omitted. To prevent the figure from being complicated, the switch signal forming unit 9, the motor driving circuit 4, the hand 6 and the like are omitted.

The electronic watch shown in FIG. 19 is different from that of FIG. 6 in that an overcharge preventing unit 33 is provided. The overcharge preventing unit 33 comprises a switch element, and is turned ON under a certain condition which will be described later to short-circuit the electricity generating unit 10. The voltage detecting unit 32 has a function to output a signal FVS when voltage of the storage unit 11 becomes equal to a predetermined value. This predetermined value is set to such a voltage value that the storage unit 11 may be physically or chemically damaged when a sufficient amount of electricity is accumulated in the storage unit 11 and the electricity is accumulated more than that amount. The control unit 13 outputs a signal HCS which controls the electricity-generation detecting unit 12, and outputs a signal KCS in response to reception of the signal FVS. Reference numeral 34 represents a backflow preventing unit which prevents backflow of electricity supplied from the storage unit 11 when the electricity generated by the electricity generating unit 10 is low.

Figure 20:
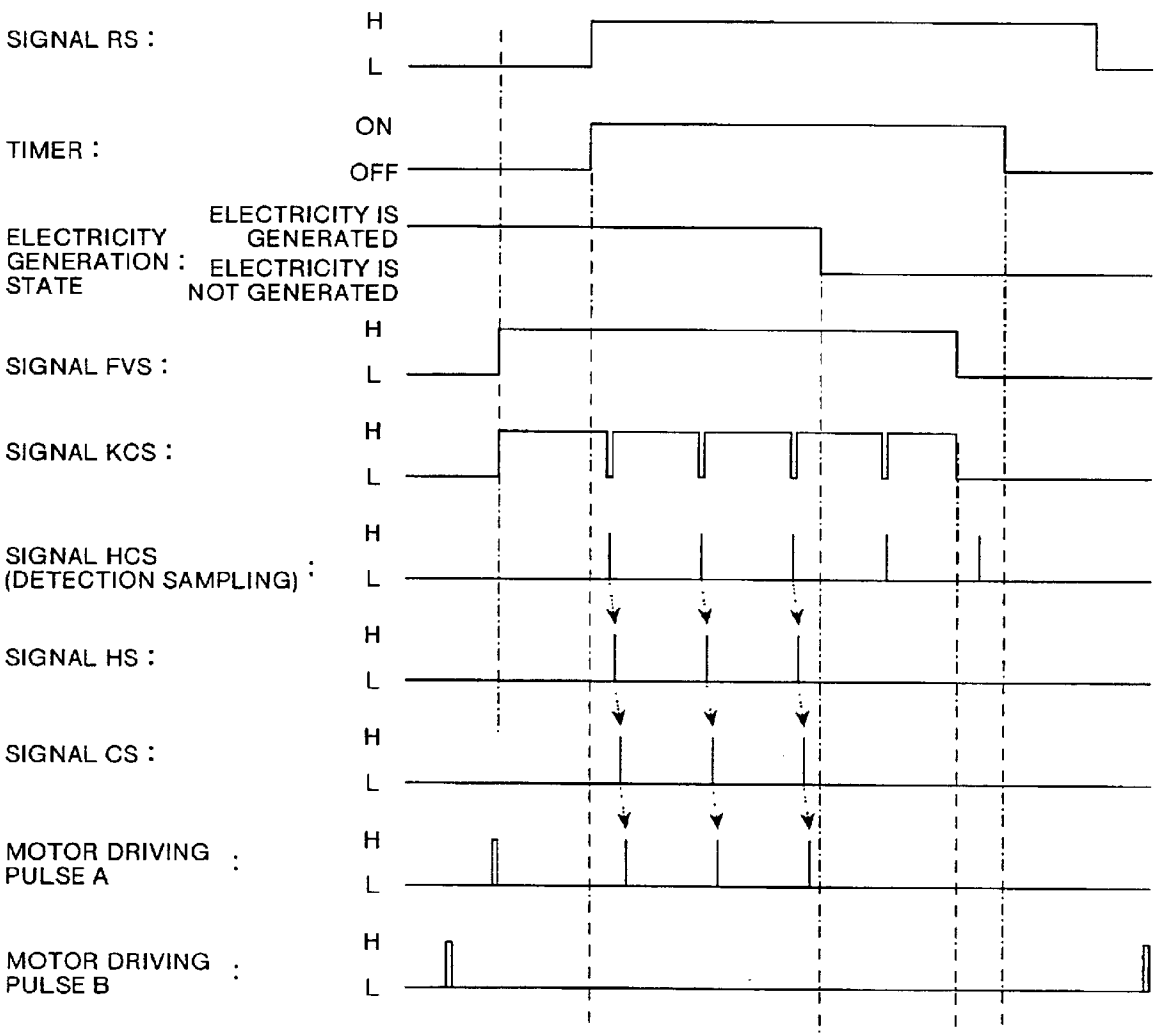
FIG. 20 is a time chart which explains the operation of the electronic watch of the tenth embodiment.

The operation of the electronic watch of the tenth embodiment will be explained below. FIG. 20 is a time chart which explains the operation of the electronic watch of the tenth embodiment.

In the time chart shown in FIG. 7, the electricity detecting unit 12 always outputs the detection sampling signal, but in the time chart shown in FIG. 20, the operation is controlled by the signal HCS that is output from the control unit 13 only when the timer 13*a* is operating.

The voltage detecting unit 32 outputs the signal FVS at logic level "H" when the voltage value of the storage unit 11 becomes equal to the predetermined value. Upon reception of this signal, the control unit 13 outputs the signal KCS at logic level "H", and the overcharge preventing unit 33 is turned ON to short-circuit the electricity generating unit 10. Thus, the supply of electricity from the electricity generating unit 10 is stopped, and the voltage of the storage unit 11 does not exceed the predetermined value.

Subsequently, when receiving the signal RS output from the switch signal forming unit 9 (not shown), the control unit 13 starts the operation of the timer 13*a* to output the signal HCS. The electricity-generation detecting unit 12 is brought into the operative state based on this signal, and detects whether the electricity generating unit 10 is generating electricity. At that time, the control unit 13 changes the logic level of the signal KCS to the logic level "L" in sync with the output timing of the signal HCS. Therefore, the overcharge preventing unit 33 is OFF during a period in which the signal KCS is at logic level "L" even when the signal FVS is output.

The reason why the overcharge preventing unit 33 is thus controlled is that the electricity-generation detecting unit 12 can not detect electricity generated by the electricity generating unit 10 since the electricity generating unit 10 is short-circuited in a state in which the overcharge preventing unit 33 is ON. The control unit 13 increases the width of the logic level "L" of the signal KCS with respect to the width of the logic level "H" of the signal HCS. By doing so, it is possible to reliably bring the overcharge preventing unit 33 into an OFF state during the operation of the electricity-generation detecting unit 12. Since electricity generated by the electricity generating unit 10 is supplied to the storage unit 11 while the signal KCS is at logic level "L", the voltage value may exceed the predetermined value. However, the state of the logic level "L" is set extremely shorter than the logic level "H" of the signal KCS, and therefore no problem arises.

Subsequently, when it is brought into non-electricity generating state and the signal FVS becomes logic level "L" after a while, the signal KCS becomes logic level "L". When a timeout occurs in the timer 13*a* and the output becomes logic level "L", output of the signal HCS is stopped, and the electricity-generation detecting unit 12 is also brought into non-operative state. Other operation is as shown in FIG. 7.

As explained above, according to the electronic watch of the tenth embodiment, even when the overcharge preventing unit 33 which prevents the overcharge of the storage unit 11 is operated, the electricity-generation detecting unit 12 can precisely detect the electricity generating state. Further, since the electricity-generation detecting unit 12 operates based on the signal HCS output from the control unit 13, the operation time of the electricity-generation detecting unit 12 becomes shorter as compared with the configuration shown in FIG. 7, and electricity consumption can be reduced.

In the above-explained embodiments 1 to 8 and 10, to shift the mode to the electricity generation confirming mode in the electronic watch having the built-in electricity generating unit, the push switch 15 is operated, thereby flowing the fine current through the coil 4*a* of the motor 5, the fine current is detected by the external device, and the presence or absence of the electricity generating operation is confirmed. The idea itself that fine current is flown through the coil 4*a* of the motor 5 by operating the external operating member such as the stem switch 8, the push switch 15 or the like and the fine current is detected by the external device, is not limited to the electronic watch having the electricity generating unit.

Figure 21:
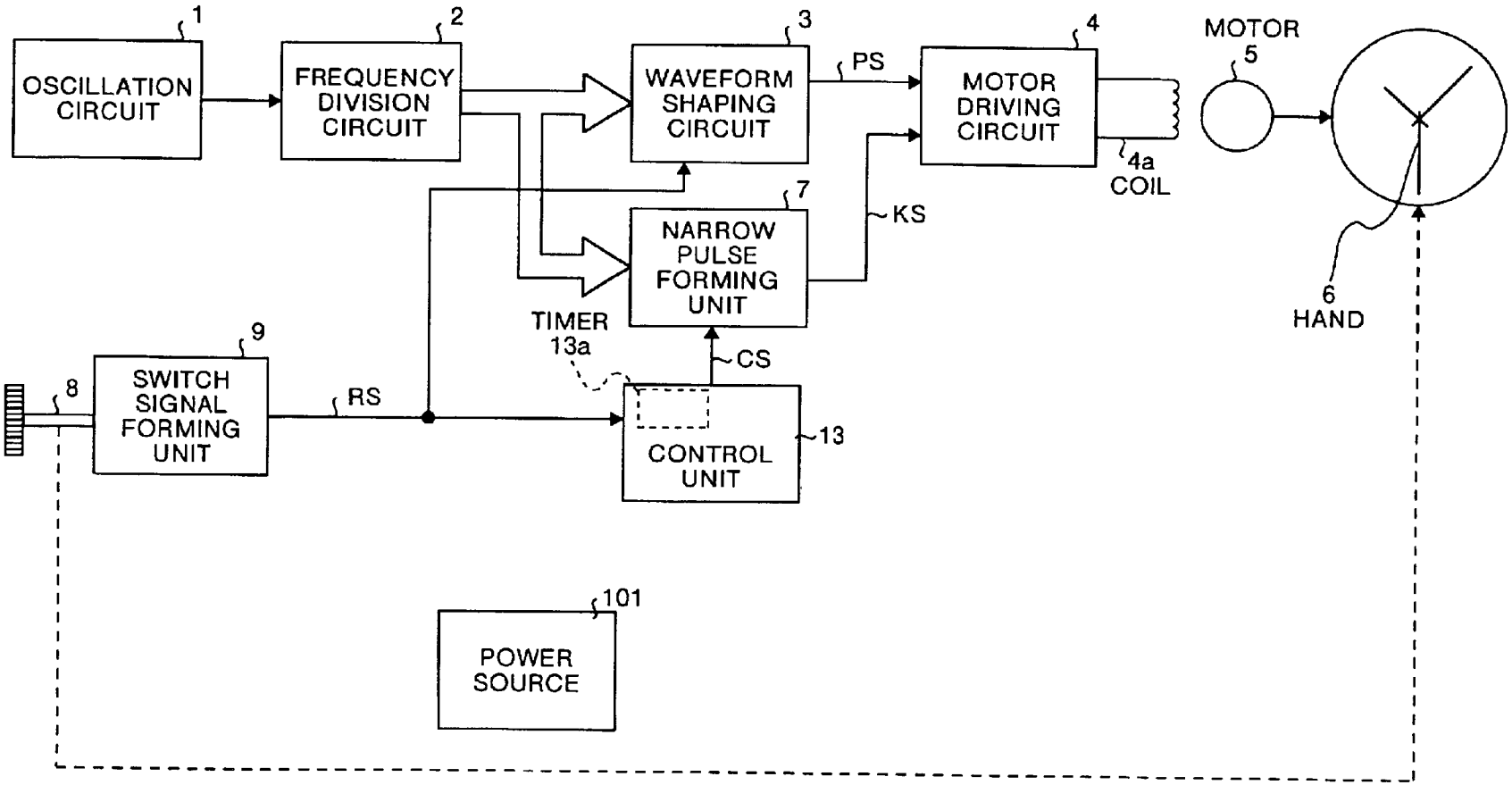
FIG. 21 is a block diagram which schematically shows a configuration of the electronic watch having a power source instead of an electricity generating unit and a storage unit in the structure explained in the first embodiment.

FIG. 21 is a block diagram which schematically shows a configuration of an electronic watch having an ordinary power source instead of the electricity generating unit and the storage unit based on the configuration explained in the first embodiment. With such a configuration, it is also possible to consider such application that a narrow pulse is regarded as a rate pulse and the rate pulse can be detected only when the stem switch 8 is pulled out.

Industrial Applicability

As described above, the electronic watch of the present invention is capable of easily confirming the operation of the electricity generating unit in a state of a product mode, and it is therefore suitable to realize a reliable and simple inspection step especially on the side of a manufacturer.

What is claimed is:

1. An electronic watch provided with an electricity generating unit that generates the electric power required to drive the electronic watch, the electronic watch comprising:

an external operating member;

an operation detecting unit which outputs an operation signal when the external operating member is operated;

an electricity-generation detecting unit which outputs an electricity-generation detecting signal when it is detected that the electricity generating unit is generating electricity;

an informing unit which informs outside of an electricity generation state of the electricity generating unit in accordance with the electricity-generation detecting signal only during a predetermined clocking time which is started based on the operation signal;

at least an hour hand and a minute hand;

a hand rotating unit which rotates the hour and minute hands of the electronic watch; and a waveform shaping unit which forms a driving pulse for carrying out a clocking operation, wherein the informing unit changes a driving mode of the hand rotating unit based on the operation signal, the electricity-generation detecting signal, and the driving pulse, wherein the driving mode is changed to a non-driving state from a driving state by providing a plurality of narrow pulsewidth signals to the hand rotating unit the narrow pulsewidth signals having a narrower pulsewidth than the driving pulse.

2. An electronic watch provided with an electricity generating unit that generates the electric power required to drive the electronic watch, the electronic watch comprising:

an electricity-generation detecting unit which outputs an electricity-generation detecting signal when it is detected that the electricity generating unit is generating electricity;

at least an hour hand and a minute hand;

a hand rotating unit that has at least one motor, the hand rotating unit rotating the hour and minute hands of the electronic watch;

a waveform shaping unit which forms a driving pulse for carrying out a clocking operation;

a pulse forming unit which forms a narrow pulse based on the electricity-generation detecting signal; and a driving unit which drives the hand rotating unit based on the driving pulse and outputs the narrow pulse to the hand rotating unit that is not driven by the narrow pulse, to detect an electricity generating state of the electricity generating unit with a variation of a magnetic field outside the electronic watch based on the narrow pulse, wherein the narrow pulse has a pulsewidth narrower than the driving pulse.

3. The electronic watch according to claim 2, comprising:

an external operating member; and an operation detecting unit which outputs an operation signal when the external operating member is operated, wherein the pulse forming unit generates a narrow pulse based on the operation signal and the electricity-generation detecting signal.

4. The electronic watch according to claim 3, wherein the pulse forming unit generates the narrow pulse based on the operation signal and the electricity-generation detecting signal during a predetermined clocking period which is started based on the operation signal.

5. The electronic watch according to claim 3, wherein the electricity-generation detecting unit detects whether the electricity generating unit is generating electricity during a predetermined clocking period which is started based on the operation signal, and outputs an electricity-generation detecting signal when it is detected that electricity is generated.

6. The electronic watch according to claim 2, wherein the driving unit notifies the electricity generating state of the electricity generating unit to outside by conducting a pulse signal having a width of such a degree that the at least one motor is not driven, to a coil for driving the at least one motor based on the narrow pulse.

7. The electronic watch according to claim 2, wherein the electricity-generation detecting unit repeatedly outputs the electricity-generation detecting signal for a predetermined time when it is detected that the electricity generating unit is generating electricity.

8. The electronic watch according to claim 2, wherein the electricity-generation detecting unit outputs the electricity-generation detecting signal based on a time period or a number of repeating times which is in proportion to an electricity generating amount of the electricity generating unit.

9. The electronic watch according to claim 2, comprising:

a storage unit which stores electricity generated by the electricity generating unit; and a voltage detecting unit which outputs a voltage detection signal indicating a voltage state of the storage unit, wherein the pulse forming unit generates a narrow pulse based on at least the voltage detection signal and the electricity-generation detecting signal.

10. The electronic watch according to claim 3, wherein the pulse forming unit generates the narrow pulse based on the operation signal and the electricity-generation detecting signal during a predetermined clocking period which is started based on the electricity-generation detecting signal.

11. The electronic watch according to claim 2, comprising a rate pulse generating unit which generates rate pulses, wherein the pulse forming unit forms narrow pulses which are output at equal intervals at timing which is substantially middle between the output intervals of the rate pulses, and the driving unit notifies the output state of the rate pulses and the electricity generating state of the electricity generating unit to outside by conducting a pulse signal having a width of such a degree that the at least one motor is not driven, to a coil for driving the at least one motor based on the rate pulses and narrow pulses.

12. The electronic watch according to claim 3, wherein the external operating member is a stem switch.

13. The electronic watch according to claim 3, wherein the external operating member is a push switch.

14. The electronic watch according to claim 3, wherein the external operating member is a push switch, and the pulse forming unit generates the narrow pulse based on the operation signal and the electricity-generation detecting signal during a predetermined clocking period which is started in immediate response to release of the push switch that is kept pushed for more than a predetermined time.

15. The electronic watch according to claim 2, comprising:

a first external operating member;

a second external operating member;

a first operation detecting unit which outputs a first operation signal when the first external operating member is operated; and a second operation detecting unit which outputs a second operation signal when the second external operating member is operated, wherein the pulse forming unit generates the narrow pulse based on the first operation signal, the second operation signal, and the electricity-generation detecting signal.

16. The electronic watch according to claim 15, wherein the pulse forming unit generates the narrow pulse based on the electricity-generation detecting signal during a predetermined first clocking period which is started based on the first operation signal or during a second clocking period which is determined based on the first operation signal and the second operation signal.

17. The electronic watch according to claim 14, wherein the narrow pulse is not generated during a predetermined time immediately after the push switch pushed down for more than a predetermined time is released within the clocking period.

18. The electronic watch according to claim 2, comprising:

a storage unit which stores electricity generated by the electricity generating unit;

a voltage detecting unit which outputs a voltage detection signal indicating a voltage state of the storage unit; and an overcharge preventing unit which prevents overcharge of the storage unit by being controlled based on the voltage detection signal, wherein the overcharge preventing unit is brought into a non-operative state at timing at which the electricity-generation detecting unit operates.

19. An electronic watch comprising:

at least an hour hand and a minute hand;

a hand rotating unit that has at least one motor, the hand rotating unit rotating the hour and minute hands of the electronic watch;

an external operating member;

an operation detecting unit which outputs an operation signal when the external operating member is operated;

a waveform shaping unit which forms a driving pulse which carries out a clocking operation;

a pulse forming unit which forms a narrow pulse based on the operation signal; and a driving unit which drives the hand rotating unit based on the driving pulse, and which conducts a pulse signal having a width of such a degree that the hand rotating unit is not driven based on a pulsewidth of the narrow pulse that has the pulse width narrower than the driving pulse, to a coil for driving the hand rotating unit.

20. The electronic watch according to claim 1, wherein the hand rotating unit comprises at least one motor having a coil, wherein a fine variation in a magnetic field of the coil is detected external to the electronic watch when the narrow pulse is provided to the at least one motor, in order to determine whether or not the electricity generating unit is generating electricity.

21. The electronic watch according to claim 19, wherein the at least one motor includes a coil, wherein a fine variation in a magnetic field of the coil is detected external to the electronic watch when the narrow pulse is provided to the at least one motor, in order to determine whether or not the electricity generating unit is generating electricity.

22. An electronic watch provided with an electricity generating unit that generates the electric power required to drive the electronic watch, the electronic watch comprising:

an external operating member;

an operation detecting unit which outputs an operation signal when the external operating member is operated;

an electricity-generation detecting unit which outputs an electricity-generation detecting signal when it is detected that the electricity generating unit is generating electricity; and an informing unit which informs, external to the electronic watch, of an electricity generating state of the electricity generating unit in accordance with the electricity-generation detecting signal only during a predetermined clocking time which is started based on the operation signal, and stops informing of the electricity generating state after the predetermined clocking time has passed.

23. The electronic watch according to claim 22, further comprising:

at least an hour and a minute hands;

a hand rotating unit that has at least one motor, the hand rotating unit rotating the hour and minute hands of the electronic watch; and a waveform shaping unit which forms a driving pulse for carrying out a clocking operation, wherein the informing unit changes a driving mode of the motor based on the operation signal, the electricity-generation detecting signal, and the driving pulse.

24. An electronic watch provided with an electricity generating unit that generates the electric power required to drive the electronic watch, the electronic watch comprising:

an electricity-generation detecting unit which outputs an electricity-generation detecting signal when it is detected that the electricity generating unit is generating electricity;

at least one hand;

at least one motor for rotating the at least one hand of the electronic watch;

a waveform shaping unit which forms a driving pulse for carrying out a clocking operation;

a pulse forming unit which forms a narrow pulse based on the electricity-generation detecting signal; and a motor driving unit which drives the at least one hand based on the driving pulse to make the at least one motor rotate the at least one hand, and conducts such a pulse signal that the at least one motor is not driven thereby and changes a magnetic field outside the electronic watch, to the at least one motor based on the narrow pulse to make an external device detect an electricity generating state of the electricity generating unit.

25. The electronic watch according to claim 24, further comprising:

an external operating member; and an operation detecting unit which outputs an operation signal when the external operating member is operated, wherein the pulse forming unit generates a narrow pulse based on the operation signal and the electricity-generation detecting signal.

26. The electronic watch according to claim 25, wherein the pulse forming unit generates the narrow pulse based on the operation signal and the electricity-generation detecting signal during a predetermined clocking period which is started based on the operation signal.

27. The electronic watch according to claim 25, wherein the electricity-generation detecting unit detects whether the electricity generating unit is generating electricity during a predetermined clocking period which is started based on the operation signal, and outputs an electricity-generation detecting signal when it is detected that electricity is generated.

28. The electronic watch according to claim 24, wherein the motor driving unit notifies, external to the electronic watch, the electricity generating state of the electricity generating unit by conducting a pulse signal having a width of such a degree that the at least one motor is not driven, to a coil for driving the at least one motor based on the narrow pulse.

29. The electronic watch according to claim 24, wherein the electricity-generation detecting unit repeatedly outputs the electricity-generation detecting signal for a predetermined time when it is detected that the electricity generating unit is generating electricity.

30. The electronic watch according to claim 24, wherein the electricity-generation detecting unit outputs the electricity-generation detecting signal based on a time period or a number of repeating times which is in proportion to an electricity generating amount of the electricity generating unit.

31. The electronic watch according to claim 24, further comprising:

a storage unit which stores electricity generated by the electricity generating unit; and a voltage detecting unit which outputs a voltage detection signal indicating a voltage state of the storage unit, wherein the pulse forming unit generates a narrow pulse based on at least the voltage detection signal and the electricity-generation detecting signal.

32. The electronic watch according to claim 25, wherein the pulse forming unit generates the narrow pulse based on the operation signal and the electricity-generation detecting signal during a predetermined clocking period which is started based on the electricity-generation detecting signal.

33. The electronic watch according to claim 24, further comprising a rate pulse generating unit which generates rate pulses, wherein the pulse forming unit forms narrow pulses which are output at equal intervals at a timing which is substantially midway between output intervals of the rate pulses, and the motor driving unit notifies, external to the electronic watch, the output state of the rate pulses and the electricity generating state of the electricity generating unit by conducting a pulse signal having a width of such a degree that the at least one motor is not driven, to a coil for driving the at least one motor based on the rate pulses and narrow pulses.

34. The electronic watch according to claim 25, wherein the external operating member is a stem switch.

35. The electronic watch according to claim 25, wherein the external operating member is a push switch.

36. The electronic watch according to claim 25, wherein the external operating member is a push switch, and the pulse forming unit generates the narrow pulse based on the operation signal and the electricity-generation detecting signal signal during a predetermined clocking period which is started in immediate response to release of the push switch that is kept pushed for more than a predetermined time.

37. The electronic watch according to claim 24, further comprising:

a first external operating member;

a second external operating member;

a first operation detecting unit which outputs a first operation signal when the first external operating member is operated; and a second operation detecting unit which outputs a second operation signal when the second external operating member is operated, wherein the pulse forming unit generates the narrow pulse based on the first operation signal, the second operating signal, and the electricity-generation detecting signal.

38. The electronic watch according to claim 37, wherein the pulse forming unit generates the narrow pulse based on the electricity-generation detecting signal during a predetermined first clocking period which is started based on the first operation signal or during a second clocking period which is determined based on the first operation signal and the second operating signal.

39. The electronic watch according to claim 36, wherein the narrow pulse is not generated during a predetermined time immediately after the push switch pushed down for more than a predetermined time is released within the clocking period.

40. The electronic watch according to claim 24, further comprising:

a storage unit which stores electricity generated by the electricity generating unit;

a voltage detecting unit which outputs a voltage detection signal indicating a voltage state of the storage unit; and an overcharge preventing unit which prevents overcharge of the storage unit by being controlled based on the voltage detection signal, wherein the overcharge preventing unit is brought into a non-operative state at timing at which the electricity-generation detecting unit operates.

41. An electronic watch provided with an electricity generating unit that generates the electric power required to drive the electronic watch, the electronic watch comprising:

an electricity-generation detecting unit which outputs an electricity-generation detecting signal when it is detected that the electricity generating unit is generating electricity.

at least one hand;

at least one motor for rotating the at least one hand of the electronic watch;

a waveform shaping unit which forms a driving pulse for carrying out a clocking operation; and a motor driving unit which drives the at least one motor based on the driving pulse to make the at least one motor rotate the at least one hand, and conducts such a pulse signal that the at least one motor is not driven thereby and changes a magnetic field outside the electronic watch, to the at least one motor based on the electricity-generation detecting signal to make an external device detect an electricity generating state of the electricity generating unit.

* * * * *